US006909241B2

(12) United States Patent
Seo et al.

(10) Patent No.: US 6,909,241 B2
(45) Date of Patent: Jun. 21, 2005

(54) METHOD OF DRIVING PLASMA DISPLAY PANEL AND PLASMA DISPLAY DEVICE

(75) Inventors: Yoshiho Seo, Akashi (JP); Yasunobu Hashimoto, Akashi (JP)

(73) Assignee: Fujitsu Limited, Kawasaki (JP)

( * ) Notice: Subject to any disclaimer, the term of this patent is extended or adjusted under 35 U.S.C. 154(b) by 100 days.

(21) Appl. No.: 10/463,341

(22) Filed: Jun. 18, 2003

(65) Prior Publication Data

US 2003/0234750 A1 Dec. 25, 2003

(30) Foreign Application Priority Data

Jun. 21, 2002 (JP) ..... 2002-181423

(51) Int. Cl.[7] ..... G09G 3/28

(52) U.S. Cl. ..... 315/169.1; 315/169.3; 345/63; 345/77

(58) Field of Search ..... 315/169.1, 169.3, 315/169.2; 345/63, 77, 76, 78

(56) References Cited

U.S. PATENT DOCUMENTS 6,492,964 B1 * 12/2002 Mikoshiba et al. ..... 345/60
6,512,336 B2 * 1/2003 De Zwart et al. ..... 315/169.3

* cited by examiner

*Primary Examiner*—David Vu
(74) *Attorney, Agent, or Firm*—Staas & Halsey LLP

(57) ABSTRACT

A method of driving a PDP having a plurality of third electrodes intersecting the first and second electrodes, wherein in an address period, an odd-numbered electrode and even-numbered electrode, of the first electrodes are paired and are scanned in a predetermined order, and the address period is divided into a first period and a second period, wherein, in the first period one of one group of odd-numbered electroded and another group of even-numbered electrodes of the second electrodes is put in a selected state and the other group is put in an anti-selected state, and in the second period the other group of electrodes is put in the selected state and the one group of electrodes is put in the anti-selected stae for scnning the pair first ellectrodes.

10 Claims, 23 Drawing Sheets

: SYMBOL for ODD CELL POSITION

: SYMBOL FOR EVEN CELL POSITION

: Schematically showing delta shapes formed by cells(R), (G), and (B)

| STATES / SYMBOL | WHEN V(Xo)=Vxh | WHEN V(Xe)=Vxh |
|---|---|---|
| | SCAN CELL POSITION | ANTI-SCAN CELL POSITION |
| | ANTI-SCAN CELL POSITION | SCAN CELL POSITION |

METHOD OF DRIVING PLASMA DISPLAY PANEL AND PLASMA DISPLAY DEVICE

BACKGROUND OF THE INVENTION

1. Field of the Invention

The present invention relates to a method of driving a plasma display panel and to a plasma display device. Particularly, the present invention relates to a driving method for reducing address current flowing in scan electrodes and for reducing the load on scan drivers or the number of the scan drivers, a driving circuit, and so forth.

2. Description of the Related Art

First, with reference to FIG. 1, the configuration of a plasma display panel (hereinafter referred to as a PDP) will be described. FIG. 1 is an exploded perspective view in schematic form illustrating the configuration of one of pixels in the PDP. On a front substrate 10, two types of electrodes 11 and 12 for display are provided so as to be approximately parallel with one another. The plurality of electrodes 11 and 12 are provided on the entire portion of the front substrate 10 in the order shown in the drawing. These electrodes 11 and 12 are designated as sustaining electrodes. Normally, the sustaining electrodes are formed by transparent electrodes 11*i* and 12*i*, and bus electrodes 11*b* and 12*b* that are formed thereon. Further, these electrodes 11 and 12 are covered by a dielectric layer 13 having a protection layer 14 (normally MgO) on its surface.

On a back substrate 20, address electrodes 21 are provided along a direction intersecting the sustaining electrodes 11 and 12. These electrodes are covered by a dielectric layer 23. Barriers 25 are provided between the address electrodes 21, and a red fluorescent layer 26R, a green fluorescent layer 26G, and a blue fluorescent layer 26B are provided on the top surface of the dielectric layer 23, the top surface being sandwiched between the barriers 25. The above-described fluorescent layers are also provided on the sides of the barriers 25. FIG. 1 shows only one group of the above-described fluorescent layers 26R, 26G, and 26B. In reality, however, a plurality of fluorescent layers is provided corresponding to the number of pixels of the PDP.

FIG. 2A shows the configuration of a plasma display device (hereinafter referred to a PDP device) having at least one circuit for driving the above-described PDP. The sustaining electrodes 11 and 12 shown in FIG. 1 are designated as X electrodes and Y electrodes. In FIG. 2A, the X electrodes and Y electrodes are indicated by reference characters Xi (i=1, 2, 3, . . . ) and Yj (j=1, 2, 3, . . . ). The X electrodes are simultaneously driven by an X-electrode driver circuit 101, while each of Y electrodes is driven respectively by a Y scan driver 112 connected to a Y-electrode driver circuit 111 that are shown in the drawing. The address electrodes 21 (A electrodes), which are shown in FIG. 1, are indicated by reference characters Ak (k=1, 2, 3, . . . ) in FIG. 2A and are driven by an address driver 121 shown in FIG. 2A.

Next, the connection configuration of a known case is shown in FIG. 3. In this drawing, all of the Y electrodes are sequentially connected to terminals of Y scan drivers 112. Consequently, odd Y electrodes Yo and even Y electrodes Ye are connected to single IC driver, while the X electrodes are connected electrically to the X-electrode driver circuit 101.

Either the lighting (ON) or the non-lighting (OFF) of cells is selected between the address electrodes Ak and the Y electrodes Yj. As a result, some of the cells enter an ON state and emit light by sustaining discharging performed between the X electrodes and the Y electrodes. The sustaining discharging is performed by sustaining pulses applied to the entire surface of the screen. Consequently, a color image is displayed.

FIG. 2B shows an example of the Y scan driver shown in FIG. 2A. Predetermined signals are transmitted to each scan drivers 112-1, . . . , 112-n, which are provided in the Y scan driver 112, via two lines Yp and Yq. In each scan drivers 112-1, . . . , 112-n, switching elements, such as transistors or preferably field effect transistors or so on, are provided. The gates of the switching elements QP11, QN11, . . . , QP1n, QN1n, in this case, are received control signals at predetermined timing from the control circuit unit 131, and then the predetermined voltages as signals are applied to each of Y electrodes Y1, . . . , Yn which are respectively connected to the scan drivers 112-1, . . . , 112n.

Next, the configurations of driving waveforms and a frame will be described with reference to FIGS. 4 and 5. FIG. 4 respectively shows the waveforms applied to X electrode, Y1, . . . , Yn electrodes, and address electrodes.

Basically, the waveforms are divided so as to correspond to three periods including a resetting period, an address period, and sustaining period (a display period), as shown in FIG. 4. In each period, the waveforms shown in the drawing are applied to the X electrodes, Y electrodes, and A electrodes. Initialization is performed in the resetting period, predetermined cells are selected in the address period, and sustaining discharging for display is performed in the sustaining period.

As shown in FIG. 5, each of a plurality of frames for forming an image includes n sub frames corresponding to the weight of display brightness. Each of the sub frames include three periods (a resetting period, an address period, and a sustaining period) shown in FIG. 4. The lengths of the sustaining periods of the sub frames varies as shown in FIG. 5 so that weights are assigned to the lengths for performing a predetermined gradation display.

For performing driving in the address period, each of the scan electrodes (the Y electrodes) is connected to an independent scan driver, as schematically shown in FIG. 6. The plurality of scan drivers forms a group, thereby forming an LSI (the Y scan driver 112). An example of the LSI is shown in FIG. 2B. By using the Y scan driver 112, the scan pulses (voltage value-Vy pulses) in the address period shown in FIG. 4 are output to the Y electrodes.

Switching elements used for the above-described LSI may cause a voltage drop, since the on resistance of the switching elements is high. As a result, an addressing error may occur. Further, since the on resistance is high, much time is required for the rise and fall of the scan pulses. Consequently, the widths of the scan pulses are decreased and the operations become unstable.

The above-described problems are caused when current flowing in the scan electrodes (address current) is large when address discharging is performed in the address period.

Accordingly, an object of the present invention is to provide a method for driving a plasma display panel capable of reducing address current flowing in scan electrodes by spreading the address current, thereby reducing the load on scan drivers, or reducing the number of the scan drivers. Another object of the present invention is to provide a plasma display device.

SUMMARY OF THE INVENTION

For solving the above-described problems, the present invention uses a PDP having a so-called delta-cell structure (pixels arranged in a delta shape). According to a first group invention (a driving method), address current flowing in scan electrodes is spread out and reduced by adjusting the combination of the scan electrodes (Y electrodes) and common electrodes (X electrodes), and the way of applying a voltage in an address period.

In order to solving the above-described problems according to the present invention, the plasma display panel comprises a plurality of first electrodes provided on a substrate, a plurality of second electrodes, each of the plurality of second electrodes being provided between the plurality of first electrodes, a plurality of third electrodes intersecting the first and second electrodes, and discharge cells. The discharge cells perform address discharging between the first electrodes and the third electrodes and sustaining discharging between the first electrodes and the second electrodes, and can perform sustaining discharging between the first electrodes and the second electrodes that are adjacent to both sides of the first electrodes at the same time. In an address period for performing the address discharging, two electrodes, one being an odd-numbered electrode and one being an even-numbered electrode, of the first electrodes are paired with each other and are scanned in a predetermined order. The address period is divided into a first period and a second period. In the first period, one of one group of odd-numbered electrodes and another group of even-numbered electrodes of the second electrodes is put in a selected state and the other group is put in an anti-selected state. In the second period, the other group of electrodes is put in the selected state and the one group of electrodes is put in the anti-selected state for scanning the pair of first electrodes.

Furthermore, a plasma display according to the present invention comprises a plasma display panel. The plasma display panel has a plurality of first electrodes provided on a substrate, a plurality of second electrodes, each of the plurality of second electrodes being provided between the plurality of first electrodes, a plurality of third electrodes intersecting the first and second electrodes, and discharge cells. The discharge cells perform address discharging between the first electrodes and the third electrodes and sustaining discharging between the first electrodes and the second electrodes. The discharge cells further perform sustaining discharging between the first electrodes and the second electrodes that are adjacent to both sides of the first electrodes at the same time. The plasma display device further comprises at least one driving circuit for driving the first electrodes, the second electrodes, and the third electrodes. The driving circuit includes a plurality of IC drivers having a plurality of drivers for addressing the plurality of first electrodes. Odd numbered electrodes of the first electrodes and even numbered electrodes of the first electrodes are connected to different IC drivers.

DESCRIPTION OF THE PREFERRED EMBODIMENT

In the present invention, a PDP having a so-called delta cell structure (pixels arranged in a delta shape) (or a PDP having a structure similar to the above-described PDP) is used as means for spreading out and reducing a current that flows into scan electrodes when address discharging is performed in an address period.

Figure 7:
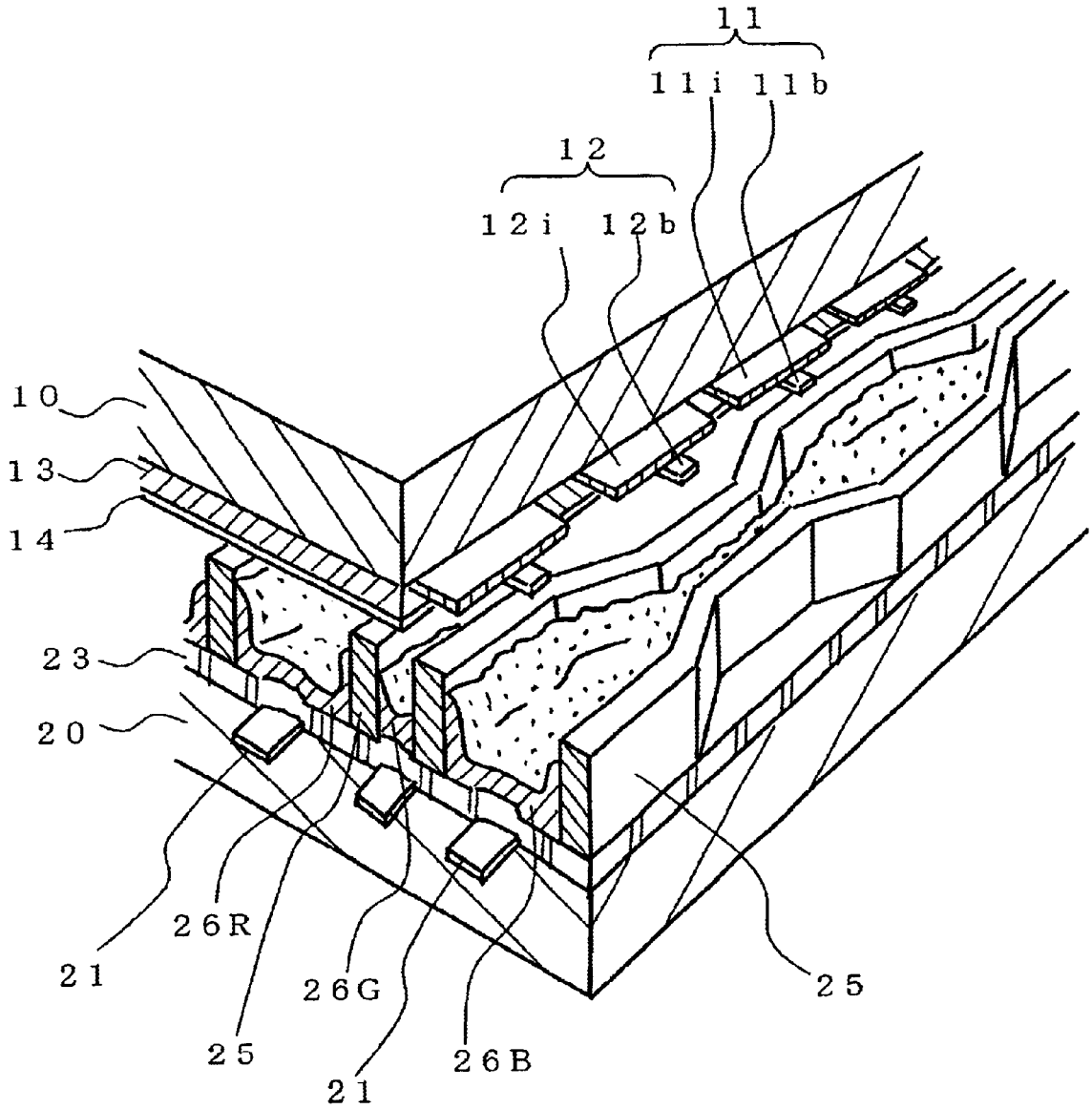
FIG. 7 is an exploded perspective view showing the configuration of a meandering rib PDP.
Figure 8:
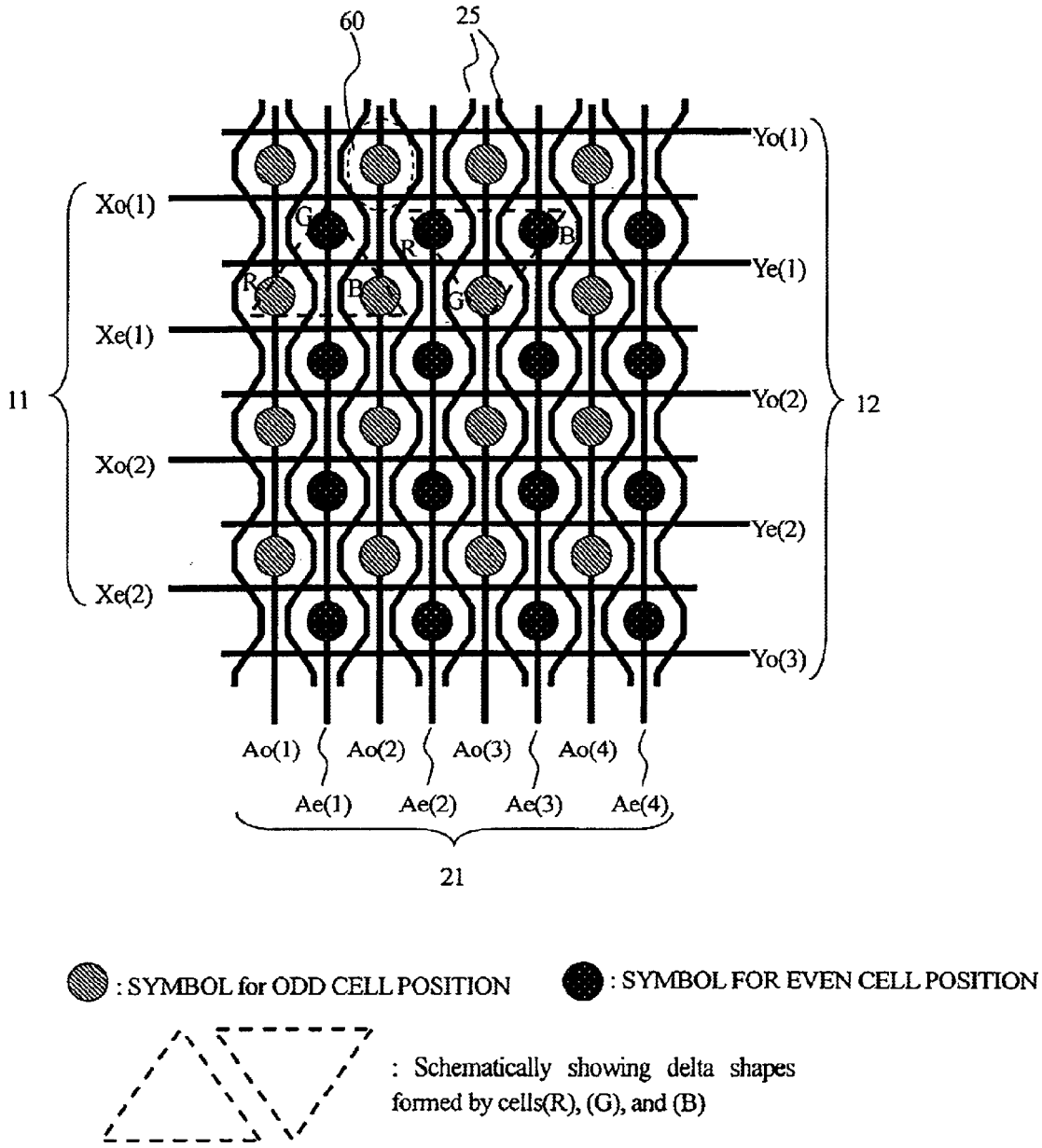
FIG. 8 is a plan view showing the configuration of a meandering rib PDP.

The above-described PDP, which has the delta-cell structure, will now be described with reference to an exploded perspective view shown in FIG. 7 and a plan view shown in FIG. 8. The PDP, which is shown in FIG. 7 and FIG. 8 is designated as "a meandering rib PDP" that is disclosed in Japanese Unexamined Patent Application Publication No. 9-50768. This type of PDP is a representative example of PDPs having the delta-cell structure.

Figure 1:
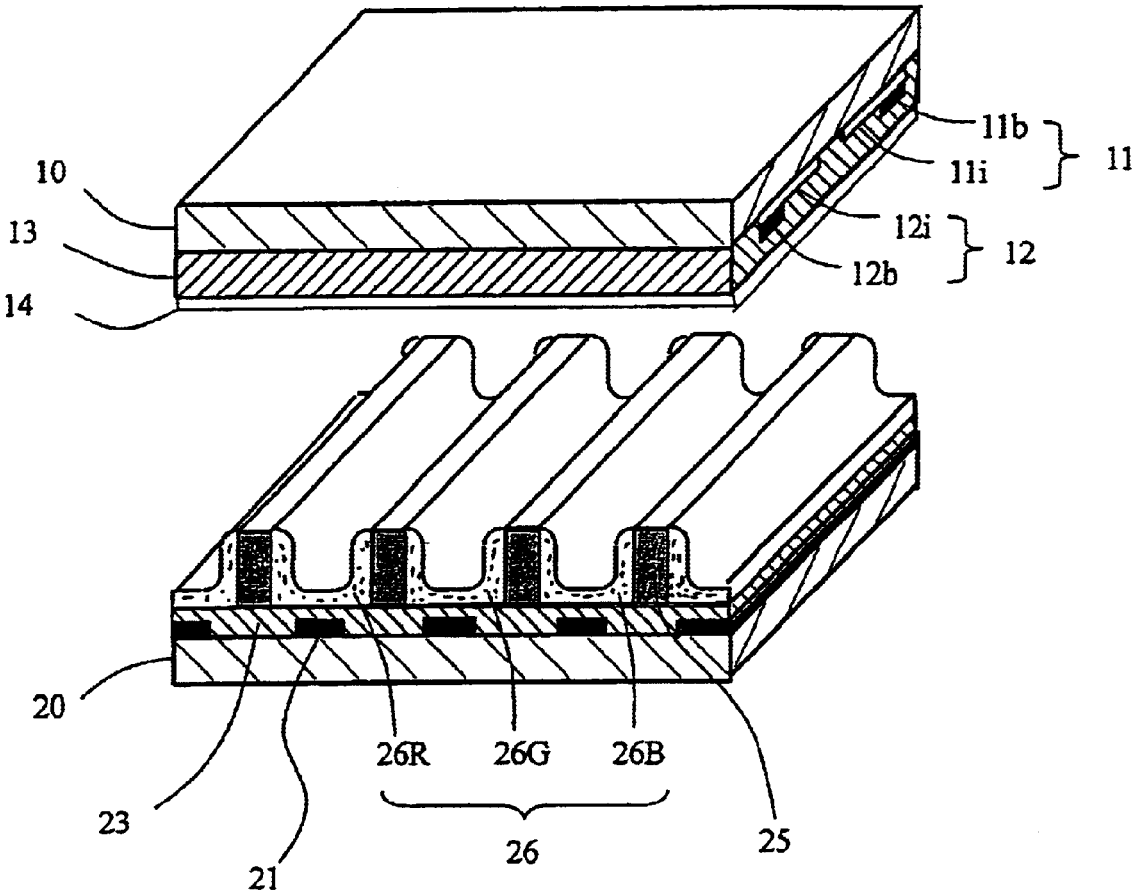
FIG. 1 PRIOR ART
FIG. 1 is an exploded perspective view showing the configuration of a known PDP.
Figure 2A:
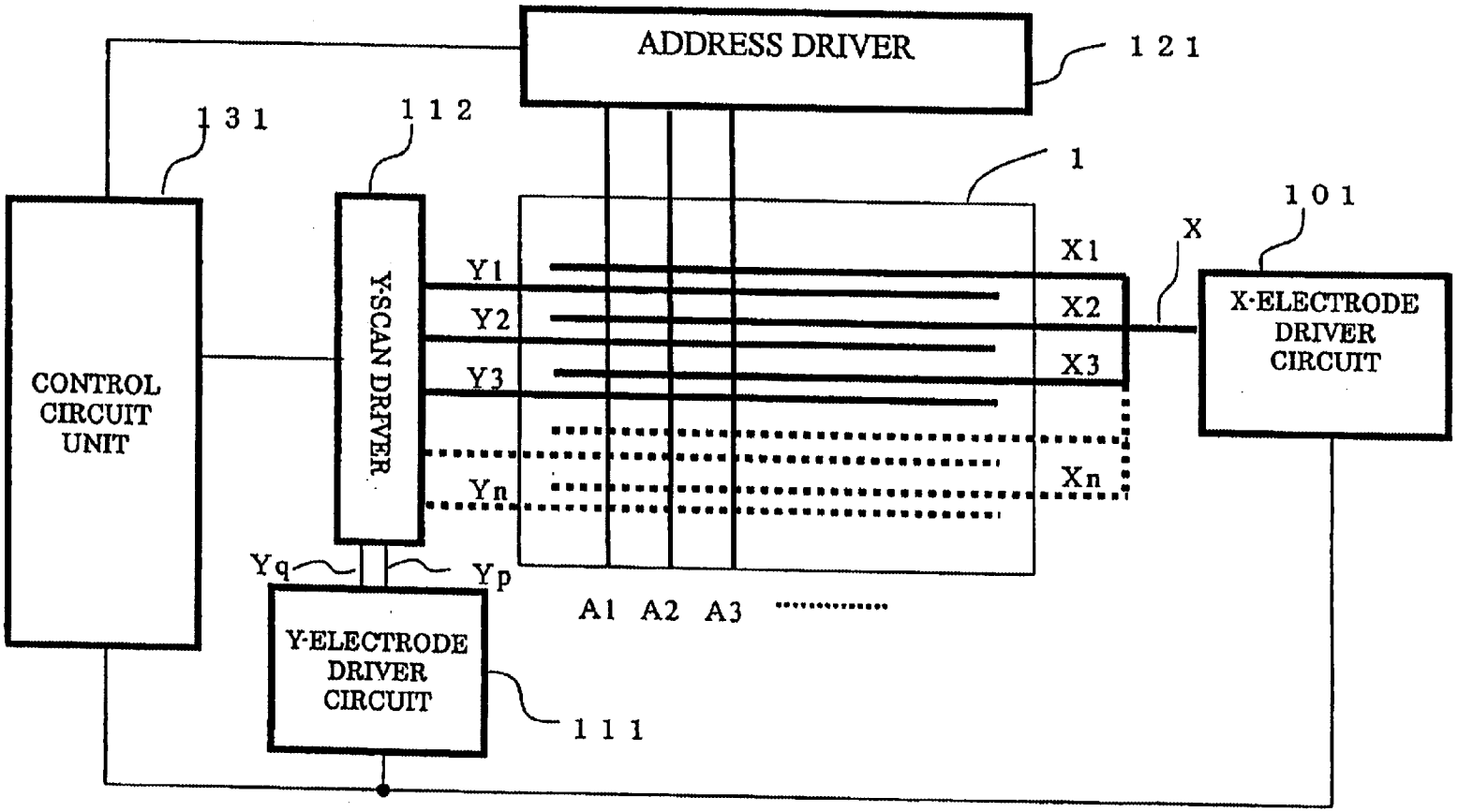
FIG. 2A PRIOR ART
FIGS. 2A and 2B show the configuration of a plasma display device and an example of the Y scan driver connected to the Y-electrode driver circuit shown in FIG. 2A.
Figure 2B:
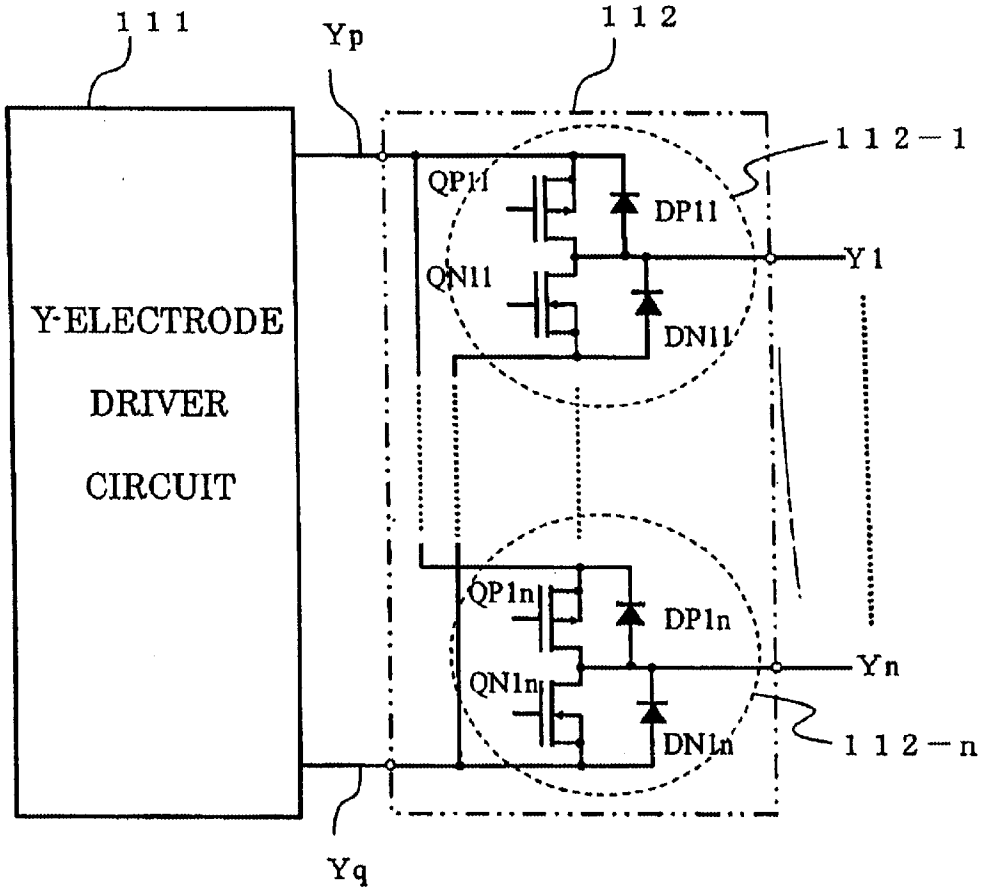
FIG. 2B PRIOR ART

The configuration of the above-described PDP including substrates 10 and 20, sustaining electrodes 11 and 12, address electrodes 21, dielectric layers 13 and 23, barriers 25, and fluorescent layers 26R, 26G, and 26B is basically similar to that of a known PDP (FIG. 1). However, the above-described PDP is different from the known PDP, especially in the following three respects.

In the embodiment, an electrode 11 is called X electrode 11, sustaining electrode 11, or common electrode, an electrode 12 is called Y electrode or scan electrode.

First, the shape of the barriers 25 is different from that of the known PDP. As shown in FIGS. 7 and 8, the barriers 25 have a meandering structure. (The shape of barriers of the known PDP is linear as shown in FIG. 1).

Secondly, by the meandering barriers 25, discharge cells are formed so that discharges are generated only in wide parts between the meandering barriers 25 that are adjacent to one another. Further, the plurality of discharge cells exists between one Y electrode 12 and two X electrodes 11 that are adjacent thereto, that is to say, on both sides of single Y electrode 12. These discharge cells can generate sustaining discharges at the same time. (In the case of known PDPs, discharge cells normally exist only on one side of one Y electrode.)

Thirdly, since the discharge cells can be provided on both sides of single Y electrode 12 as described above, it becomes possible to arrange discharge cells of red (R), green (G), and blue (B) in a triangular shape (a delta shape), as shown in FIG. 8. (Discharge cells of known PDPs are linearly arranged.)

(First Embodiment)

Before describing a first embodiment (FIGS. 10 and 11), the technology of driving the delta-cell PDP (FIG. 8) by normal driving waveforms (FIG. 9) will be described for comparison with the first embodiment so that the features of the first embodiment are clearly defined.

The expression "'on' the scan electrode" that will be used in the following description will now be described. The expression "on" refers to a position of a portion on the scan electrode when the PDP is installed so that the screen thereof is perpendicular to the ground and the sustaining electrodes thereof are horizontal to the ground. The expressions "'under' the scan electrode" and "'on and under' the scan electrode" should be understood in the same way.

In the delta-cell PDP shown in FIG. 8, odd-numbered X electrodes are defined as odd X electrodes Xo and even-numbered X electrodes are defined as even X electrodes Xe. Odd-numbered Y electrodes are defined as odd Y electrodes Yo and even-numbered Y electrodes are defined as even Y electrodes Ye. As shown in FIG. 8, the arrangement of these electrodes is started by using one of the Y electrodes. That is to say, the arrangement order of the electrodes is Yo(1), Xo(1), Ye(1), Xe(1), Yo(2), Xo(2), Ye(2), Xe(2), and so on. Here, a cell surrounded by the odd X electrode Xo, the odd Y electrode Yo, the even X electrode Xe, and the even Y electrode Ye is designated as an odd cell. Another cell surrounded by the odd X electrode Xo, the even Y electrode Ye, the even X electrode Xe, and the odd Y electrode Yo is designated as an even cell. An address electrode for addressing the odd cell is designated as an odd A electrode Ao. Further, another address electrode for addressing the even cell is designated as an even A electrode Ae.

Figure 4:
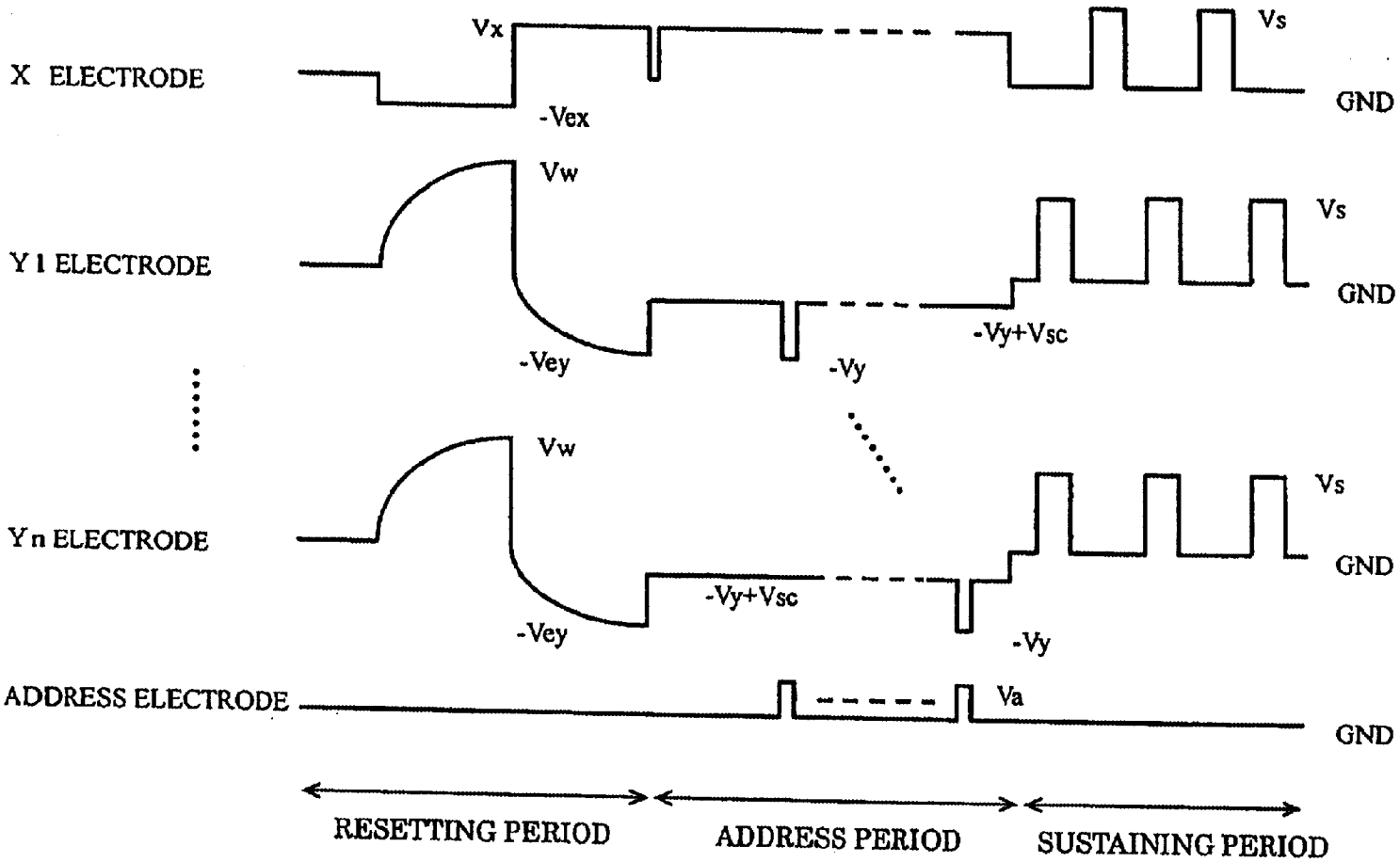
FIG. 4 PRIOR ART
FIG. 4 shows known driving waveforms.
Figure 5:
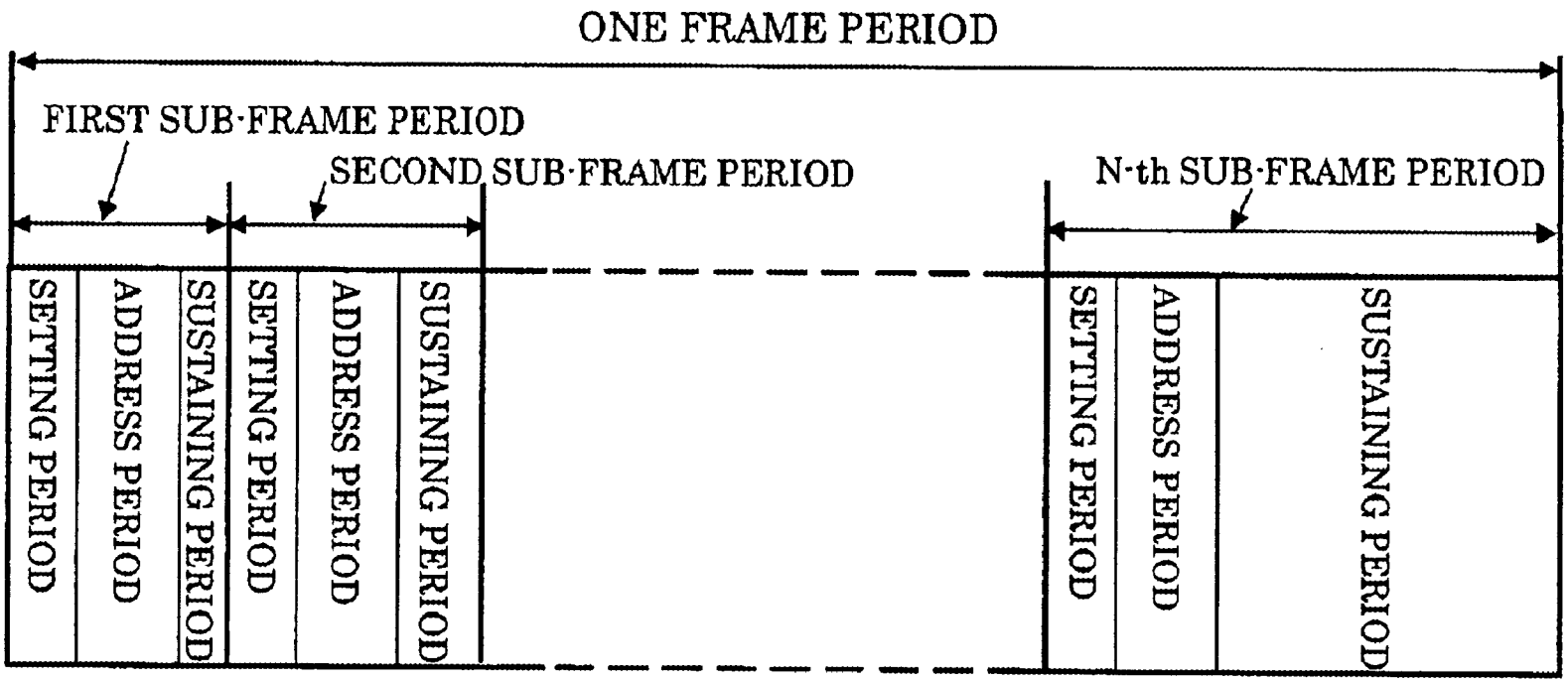
FIG. 5 shows an exemplary configuration of a frame.
Figure 9:
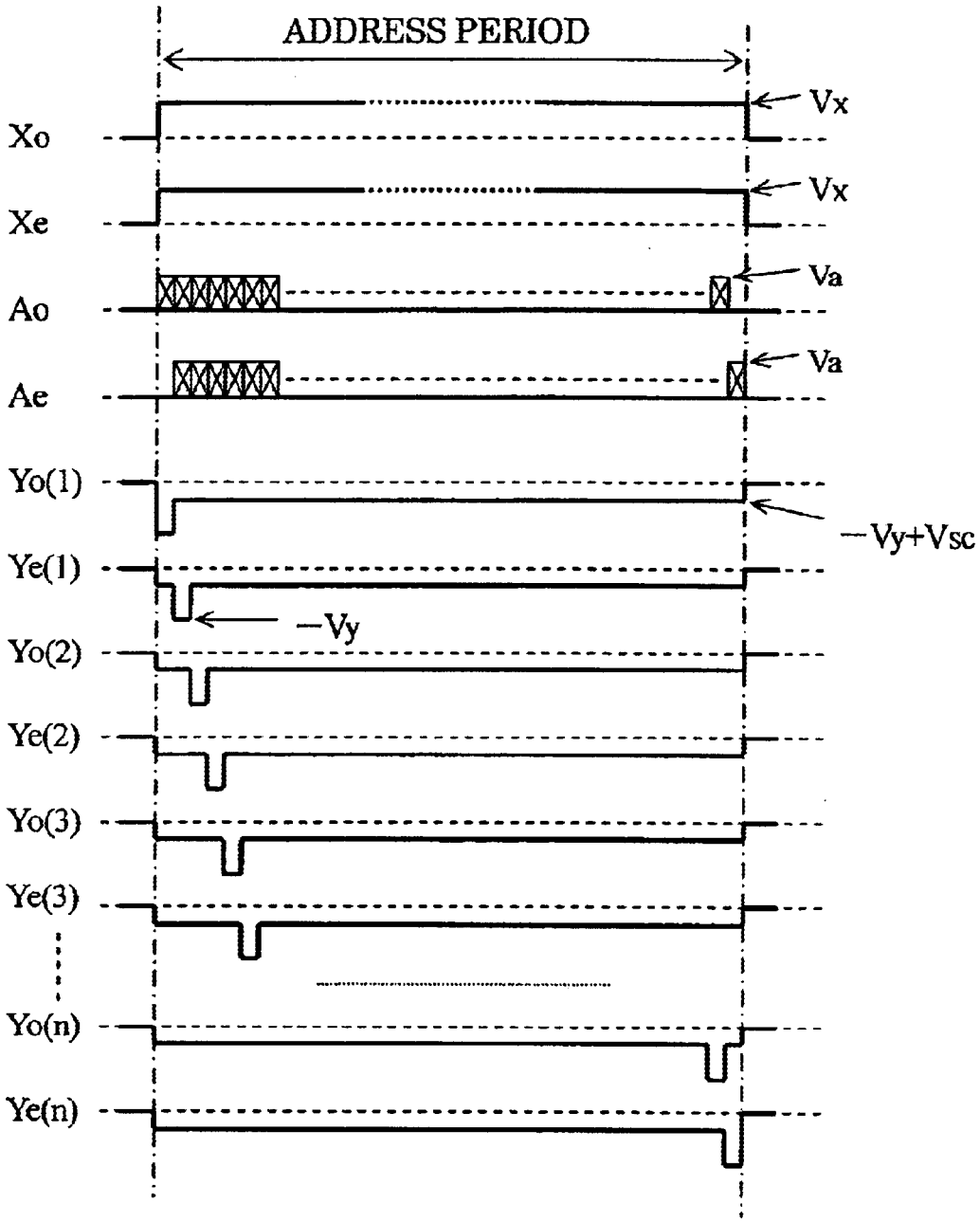
FIG. 9 shows driving waveforms for the PDP shown in FIG. 8.

FIG. 9 shows driving waveforms that are obtained when the above-described PDP is addressed by using the driving waveforms in the address period shown in FIG. 4.

For example, for scanning the odd Y electrode Yo(2) shown in FIG. 8, a group of even cells and a group of odd cells that are sandwiched between the odd Y electrode Yo(2) and the X electrodes Xe(1) and Xo(2) on both sides of the odd Y electrode Yo(2) are addressed at the same time. At this time, each of the two X electrodes Xe(1) and Xo(2) addresses one-half of the cells of one line. Therefore, the amount of current that flows when address discharging is performed is the same as that from one-half line (one-half the amount of a known case). However, address current flows into the odd Y electrode Yo(2) from both the even cells and the odd cells. Therefore, the amount of address current that flow into single Y electrode is as much as that of one line (the same amount as that of the known case).

That is to say, address discharges are generated between one Y electrode and X electrodes that are on and under the one Y electrode. Therefore, when the address discharges are generated, the amount of current that flows in each of the X electrodes is one half the amount of the known case. However, the amount of the current that flows in the Y electrode when the address discharges are generated (that is, the load on each scan driver) is the same as that of the known case.

Compared to the above-described driving method, a driving method according to a first embodiment can reduce (reduce by half) the amount of current (that is, the load on each of the scan drivers) that flows in the Y electrode when the address discharge is generated. The driving method will be described with reference to FIGS. 10 and 11.

Figure 10:
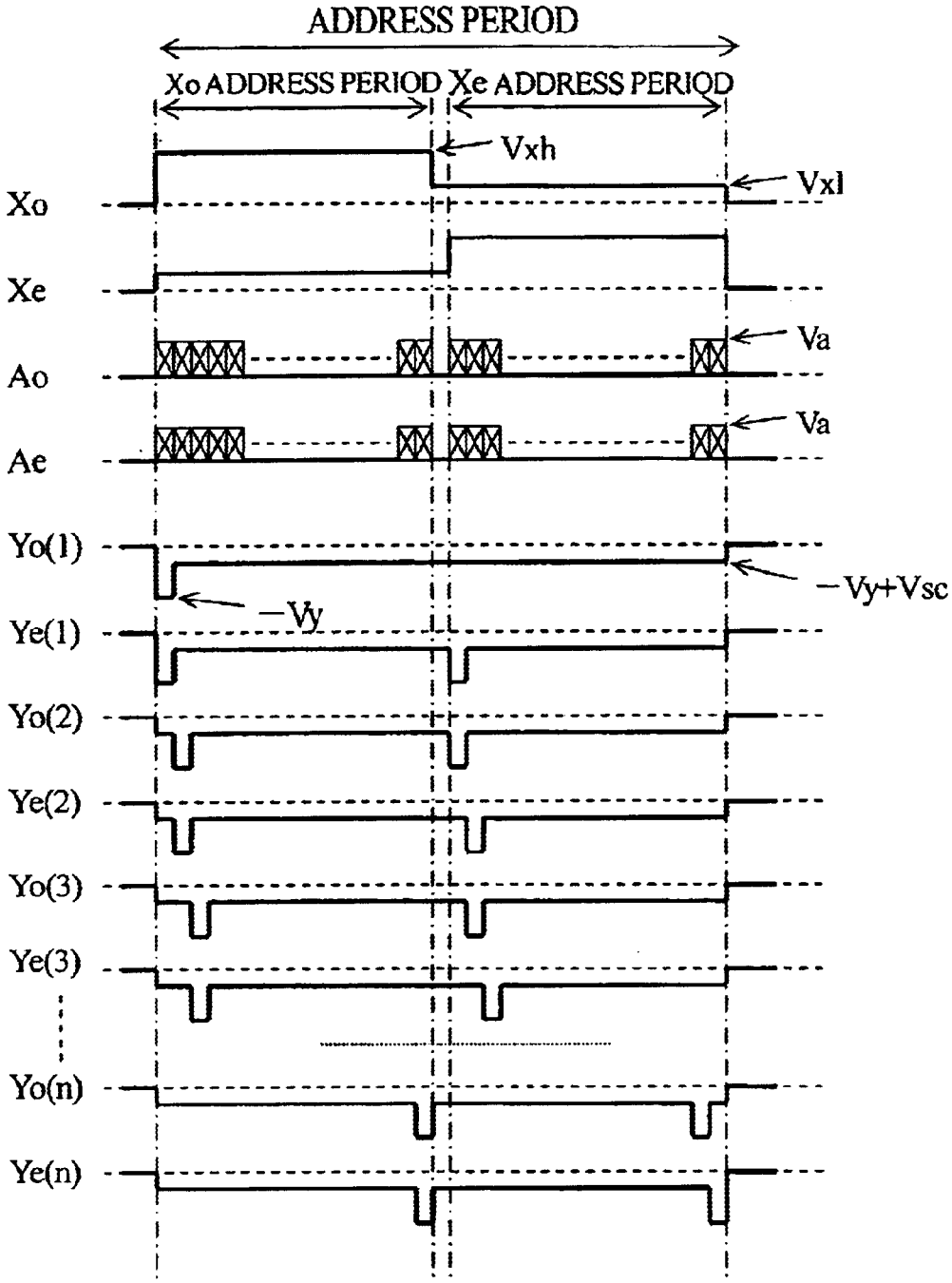
FIG. 10 shows driving waveforms according to a first embodiment.

As shown in FIG. 10, the address period is divided into an "Xo address period" for selecting cells that are provided on and under the odd X electrode Xo and an "Xe address period" for selecting cells that are provided on and under the even X electrode Xe. In the "Xo address period", the voltage of the odd X electrode Xo is set to be higher than that of the even X electrode Xe. In the "Xe address period", the voltage of the even X electrode Xe is set to be higher than that of the odd X electrode Xo. In the address period, voltages are applied to the even X electrode Xe and the odd X electrode Xo. The voltage that is higher than the other is designated as a selection X voltage Vxh and the voltage that is lower than the other is designated as an anti-selection X voltage Vxl. The former voltage is a "voltage for putting an X electrode in a 'selected state'". The latter voltage is a "voltage for putting the X electrode in an 'anti-selected state'".

Figure 11:
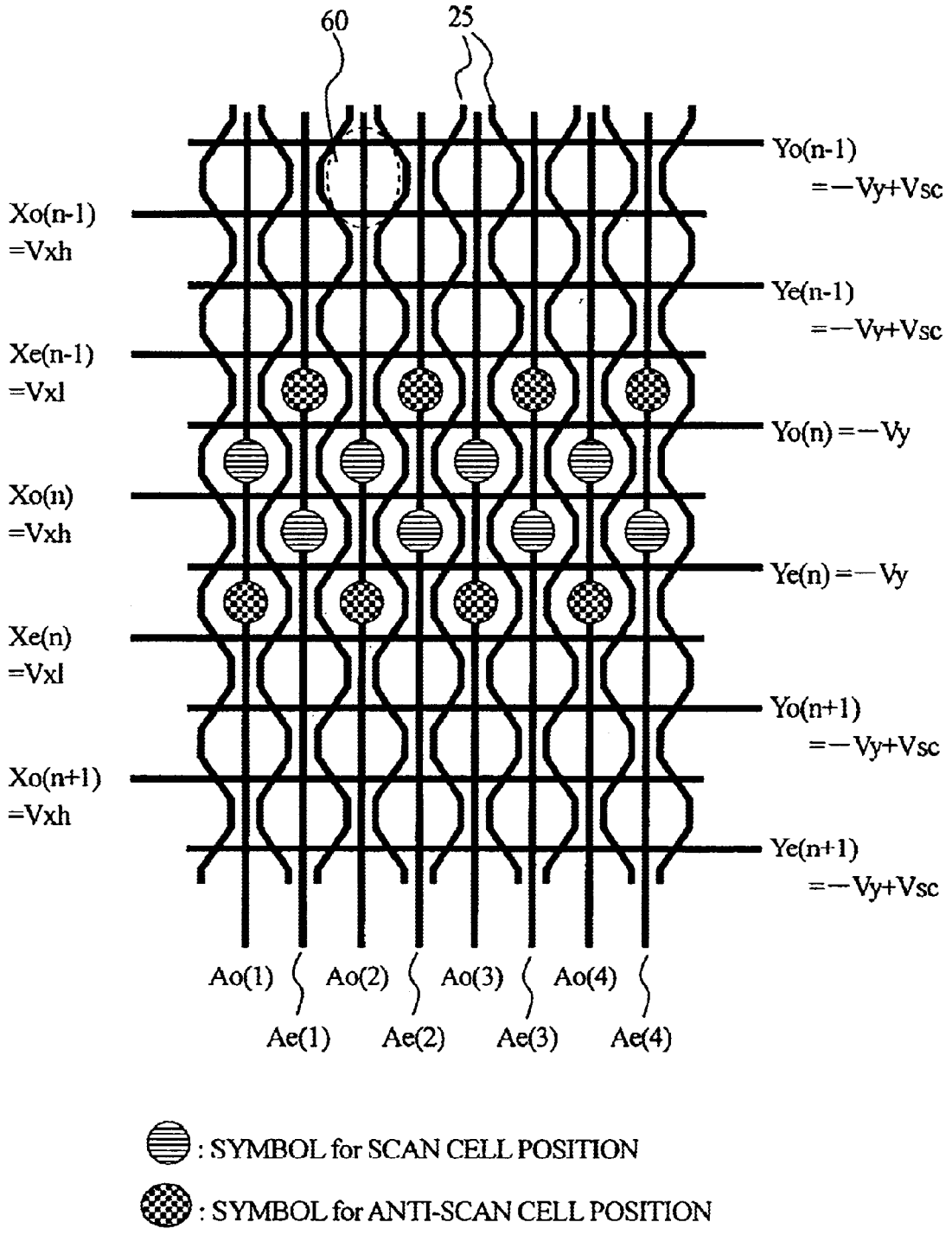
FIG. 11 shows scan cells and anti-scan cells according to the first embodiment.

Referring to FIG. 11, each of the "=" symbols adjacent to or under reference characters and numerals indicating the electrodes shows that the voltage of each of the electrodes is set to the value (Vxh, or Vxl) shown after the "=" symbol. (A similar description applies to the other "=" symbols.)

Scan voltages are simultaneously applied to a pair of (two) Y electrodes that are adjacent to each other (an odd Y electrode Yo and an even Y electrode Ye). Subsequently, cells that are provided on and under the odd X electrode Xo and cells that are provided on and under the even X electrode Xe are scanned. By scanning two Y electrodes that are paired with each other in a predetermined order according to the above-described method (as shown in FIG. 10), all of the discharge cells in the PDP can be addressed.

The voltage state and discharging state of each of the discharge cells in the "Xo address period" will be described. When the cells on and under an odd X electrode Xo (n) are addressed as shown in FIG. 11, scan voltages are applied to the odd Y electrode Yo(n) and an even Y electrode Ye(n) at the same time. Therefore, discharge cells surrounded by the odd X electrode Xo(n) and the odd Y electrode Yo(n) and discharge cells surrounded by the odd X electrode Xo(n) and the even Y electrode Ye(n) are addressed. These discharge cells are designated as scan cells. As for discharge cells surrounded by the odd Y electrode Yo(n) and an even X electrode Xe(n−1) and discharge cells surrounded by the even Y electrode Ye(n) and the even X electrode Xe(n), scan voltages are applied to the Y electrodes even though anti-selection level voltages are applied to the X electrodes. Therefore, these discharges cells are designated as anti-scan cells.

According to the above-described driving method, the address current of the upper scan cells flows to the odd Y electrode Yo(n) side, and the address current of the lower scan cells flows to the even Y electrode Ye(n) side. Therefore, the amount of current that flows in one Y electrode when the address discharges are generated is reduced by half. This is effective in terms of the ON resistances of the scan drivers.

Address currents from both the upper scan cells and the lower scan cells flow into the odd X electrode Xo(n) sandwiched between the Y electrodes Yo(n) and Yo(e). Subsequently, the amount of current flowing in the X electrodes (per one X electrode) is twice as much as that of the Y electrodes (per one Y electrode). However, in general, the X electrodes of the PDP, which is driven in the above-described manner, are connected in common in groups of N/2 (reference character N indicates the total number of X electrodes). Further, since the X electrodes are driven by a common driver having a sufficiently large current supply capacity, it is a general rule that the load on the common driver presents no problem.

However, it is preferable to achieve an improvement for reducing the amount of address current that flows in one X electrode by half. Such a technology for achieving the above-described improvement will now be described as another embodiment (a second embodiment).

The scan cells and anti-scan cells have four voltage types as shown below.

Reference characters V(X), V(Y), and V(A) indicate voltage levels applied to the X electrodes, Y electrodes, and A electrodes. In the scan cells, A. selected: V(X)=Vxh, V(Y)=−Vy, V(A)=Va, B. half-selected: V(X)=Vxh, V(Y)=−Vy+Vsc, V(A)=Va, C. anti-selected: V(X)=Vxh, V(Y)=−Vy, V(A)=0, D. reference: V(X)=Vxh, V(Y)=−Vy+Vsc, V(A)=0, in the anti-scan cells, E. quasi-selected: selected: V(X)=Vxl V(Y)=−Vy, V(A)=Va, F. quasi-half-selected: V(X)=Vxl, V(Y)=−Vy+Vsc, V(A)=Va, G. quasi-anti-selected: V(X)=Vxl, V(Y)=−Vy, V(A)=0, H. quasi-reference: V(X)=Vxl, V(Y)=−Vy+Vsc, V(A)=0.

The discharge cells in the states A to H will now be described.

First, in the scan cells,

A. Since there are sufficient potential differences between the X electrode and the Y electrode and between the A electrode and the Y electrode, a discharge is generated between the X electrode and the Y electrode, triggered by a discharge between the A electrode and the Y electrode. Subsequently, a wall electrical charge is generated.

B. Since a potential difference between the X electrode and the Y electrode and that between the A electrode and the Y electrode are small, no discharge is generated.

C. Although a potential difference between the X electrode and the Y electrode is large, a potential difference between the electrode A and the electrode Y is small. Therefore, no discharge is generated.

D. Since a potential difference between the X electrode and the Y electrode and that between the A electrode and the Y electrode are small, no discharge is generated.

Further, in the anti-scan cells,

E. Although a potential difference between the A electrode and the Y electrode is large, a potential between the X electrode and the Y electrode is small. Therefore, no discharge is generated.

F. Since a potential difference between the X electrode and the Y electrode and that between the A electrode and the Y electrode are small, no discharge is generated.

G. Since a potential difference between the X electrode and the Y electrode and that between the A electrode and the Y electrode are small, no discharge is generated.

H. Since a potential difference between the X electrode and the Y electrode and that between the A electrode and the Y electrode are small, no discharge is generated.

It becomes possible to select discharge cells corresponding only to the state of A and to make them discharge. Consequently, a predetermined address operation can be achieved.

(Second Embodiment)

Another driving method is described in a second embodiment. According to this method, address current that flows in scan electrodes can be reduced (reduced by half), as in the case of the first embodiment. Further, address discharging current flowing in common electrodes (an odd X electrode Xo and an even X electrode Xe) can be reduced to half as much as those in the case of the first embodiment.

Figure 12:
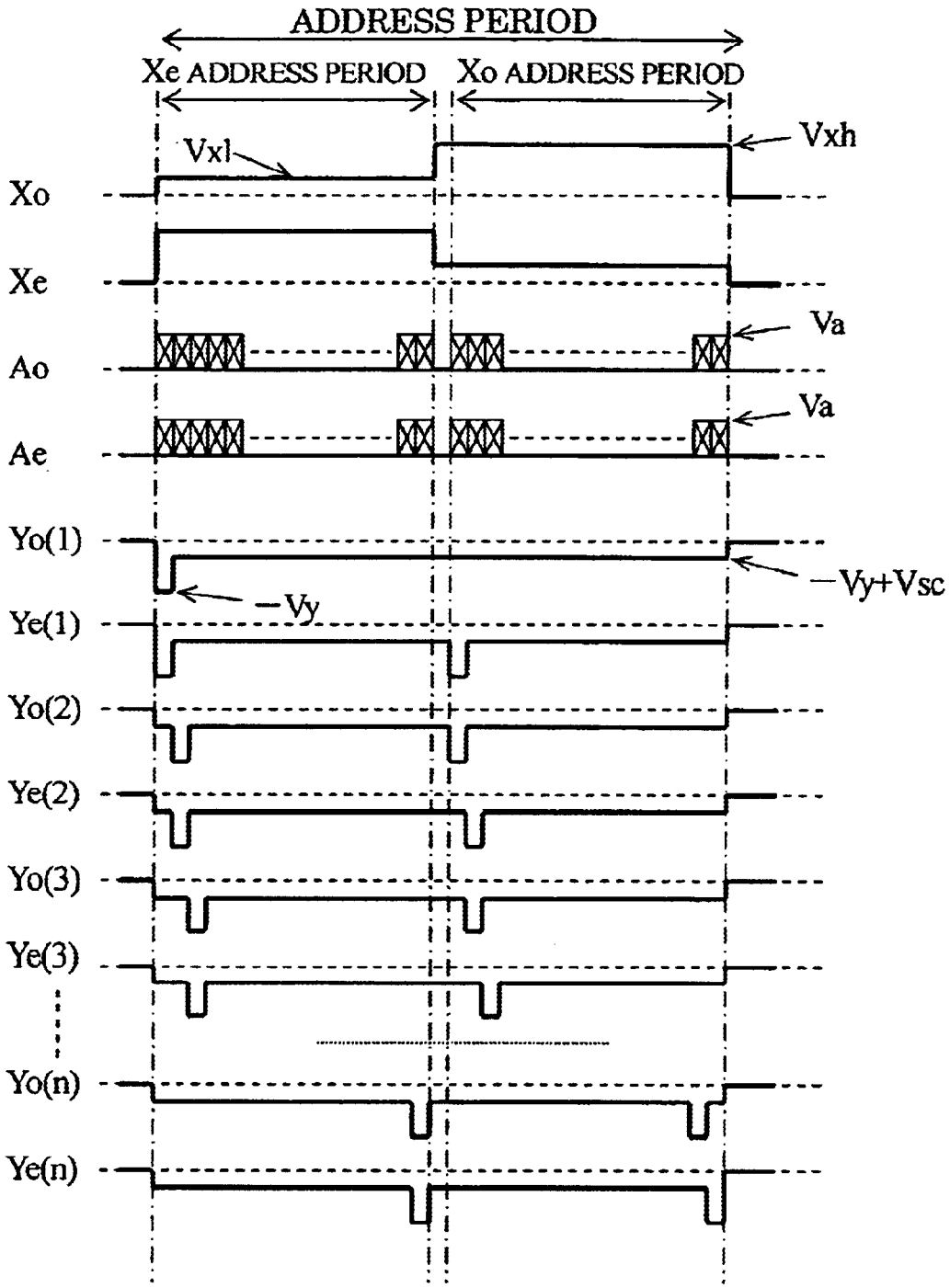
FIG. 12 shows driving waveforms according to a second embodiment.
Figure 13:
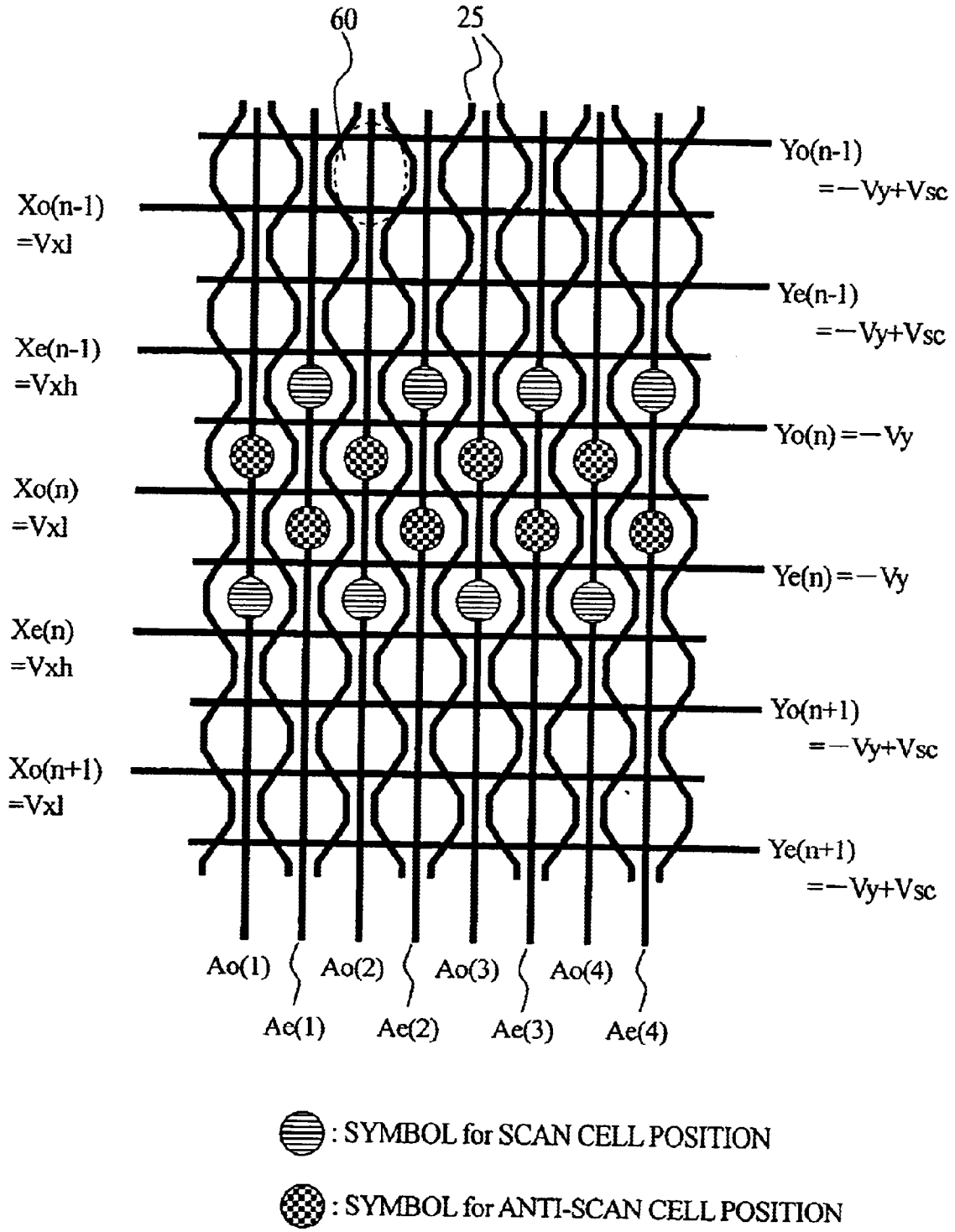
FIG. 13 shows scan cells and anti-scan cells according to the second embodiment.

More specifically, as shown in FIGS. 12 and 13, the voltage of a common electrode (an odd X electrode Xo shown in FIG. 13) sandwiched between consecutive (adjacent) scan electrodes Yo(n) and Ye(n) is designated as a low voltage Vxl (a voltage in an anti-selected state). Further, the voltage of another common electrode (an even X electrode Xe shown in FIG. 13) is designated as a high voltage Vxh (a voltage in a selected state). Consequently, discharge cells provided on the scan electrode Yo(n) and discharge cells provided under the scan electrode Ye(n) are scanned.

According to the above-described driving method, in an "Xe address period", for example, scan cells provided on the scan electrode Yo(n) in FIG. 13 are scanned by the electrodes Yo(n) and Xe(n−1). Further, scan cells provided under the scan electrode Ye(n) in FIG. 13 are scanned by the electrodes Ye(n) and Xe(n). That is to say, single X electrode and single Y electrode address scan half as many cells as that corresponding to one line. Therefore, the amount of discharge current per single X electrode and the amount of discharge current per single Y electrode are reduced by half. This effect is better than that of the first embodiment.

(Third Embodiment)

Single odd Y electrode Yo and single even Y electrode Ye that are scanned do not have to be consecutively arranged (adjacent) as in the cases of the first and second embodiments. An arbitrary odd Y electrode Yo and an arbitrary even Y electrode Ye can be scanned. However, two electrodes that are scanned at the same time must include single odd Y electrode Yo and single even Y electrode Ye.

Figure 14:
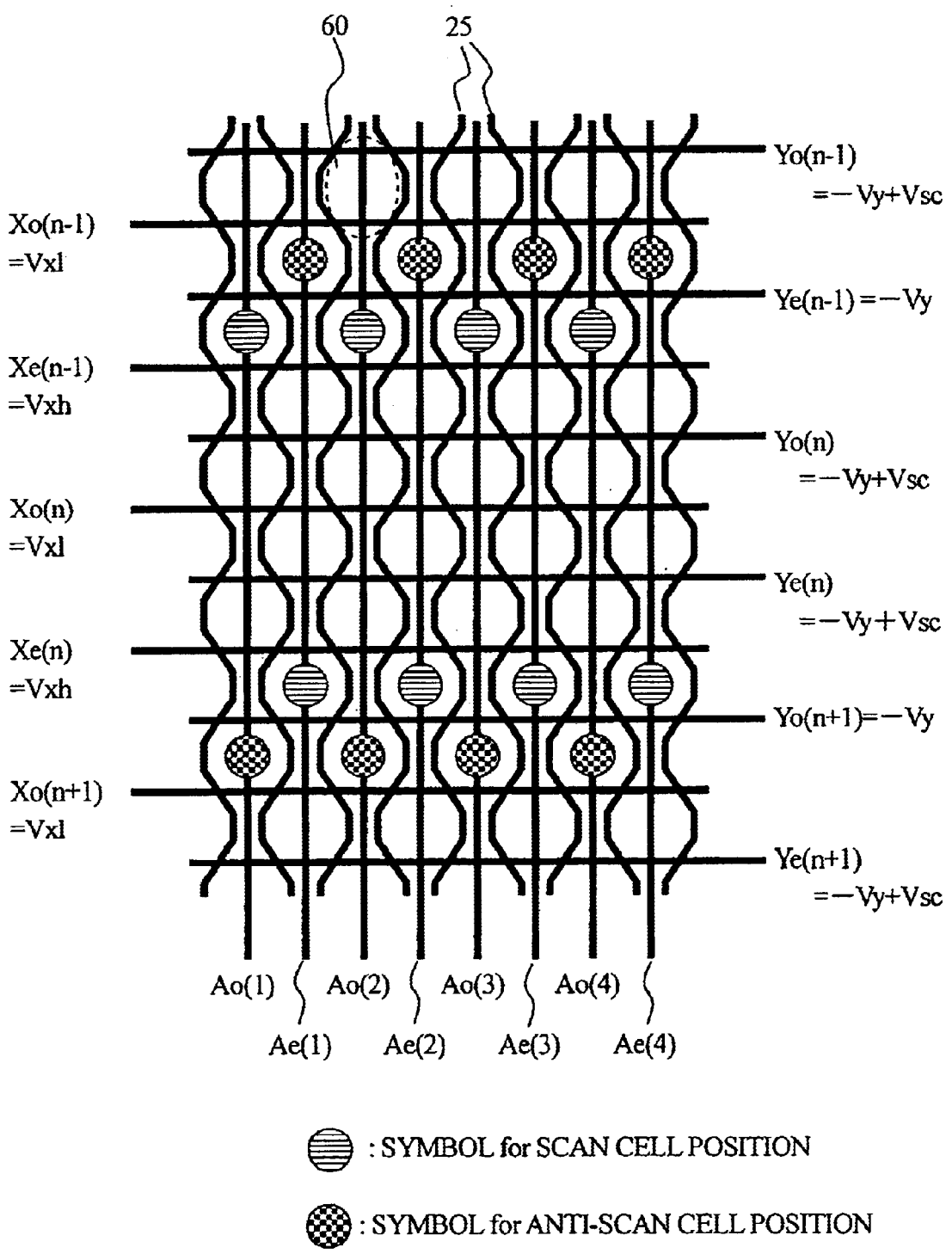
FIG. 14 shows scan cells and anti-scan cells according to a third embodiment.

This embodiment is designated as a third embodiment. FIG. 14 shows scan cells and anti-scan cells according to this embodiment. In FIG. 14, selection X voltages Vxh are applied to even X electrodes Xe, and anti-selection X voltages Vxl are applied to odd X electrodes Xo.

However, when the PDP is driven so that the anti-selection X voltages Vxl are applied to the even X electrodes Xe and the selection X voltages Vxh are applied to the odd X electrodes Xo, the relationship between the scan cells and the anti-scan cells shown in FIG. 14 is reversed.

According to this embodiment, the degree of spreading of address current flowing in the scan electrodes (the Y electrodes) and the common electrodes (the X electrodes) is the same as that in the case of the second embodiment. However, by increasing the distance between the pair of scan electrodes (the Y electrodes), the distance between drivers (an IC driver) can be increased. Consequently, more heat emitted from the IC driver can be dissipated than in the case of the second embodiment.

Control for scanning the entire screen can be performed more easily according to the second embodiment than in the case of the third embodiment.

(Fourth Embodiment)

The connection between electrodes of a PDP and Y scan drivers according to a fourth embodiment will now be described with reference to FIG. 15.

Figure 3:
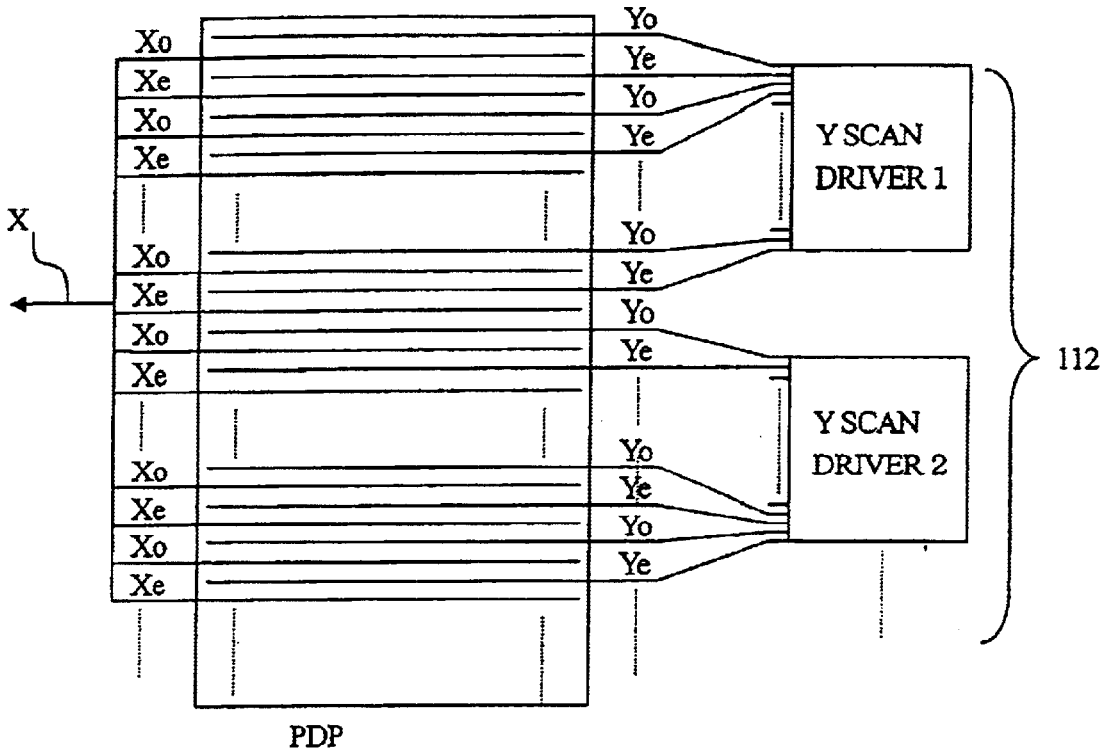
FIG. 3 PRIOR ART
FIG. 3 shows the connection configuration of known Y scan drivers.

For comparison with the fourth embodiment, the connection configuration of a known case is shown in FIG. 3. In this drawing, all of the Y electrodes are sequentially connected to terminals of Y scan drivers. Consequently, odd Y electrodes Yo and even Y electrodes Ye are connected to single IC driver.

Figure 15:
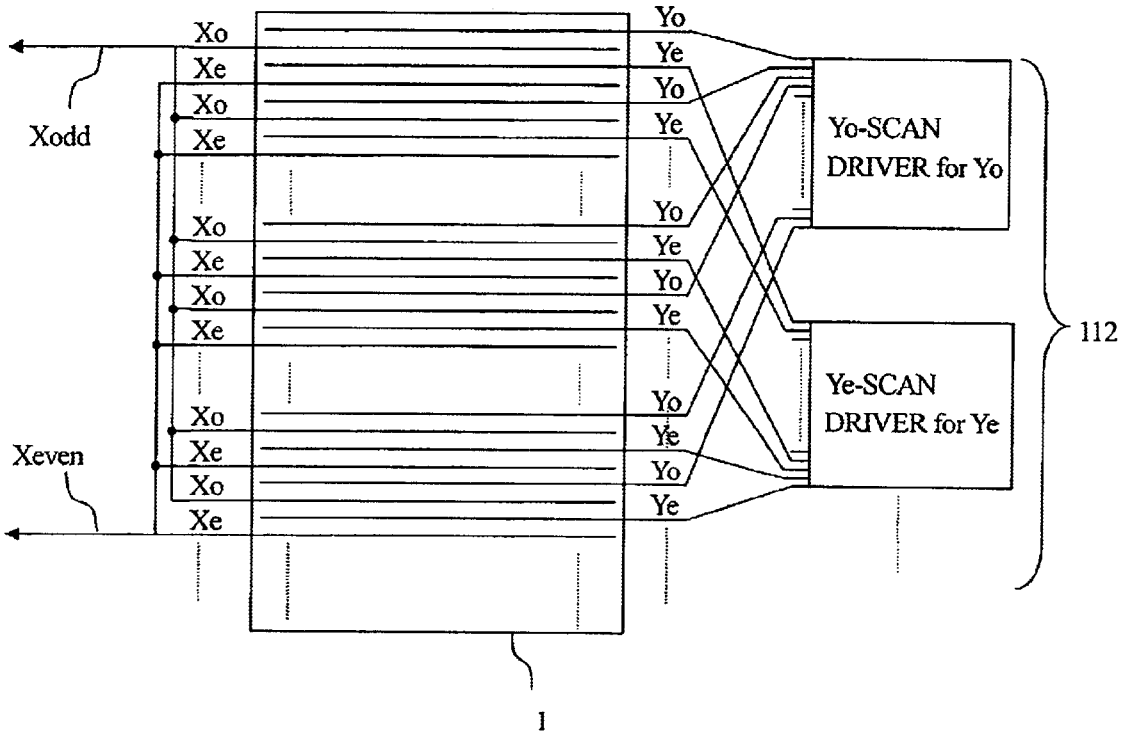
FIG. 15 shows the connection configuration of Y scan drivers according to a fourth embodiment.

However, according to the fourth embodiment, the odd Y electrodes Yo and the even Y electrodes Ye are connected to IC drivers that are different from each other, as shown in FIG. 15.

As is clear from the descriptions about the first to third embodiments, according to the present invention, the odd Y electrodes Yo are paired with the even Y electrodes Ye. Scan pulses are applied to the pairs of electrodes at the same time. Therefore, by driving the odd Y electrodes Yo and the even Y electrodes Ye by using the different IC drivers, the load on the IC drivers can be distributed between the IC drivers. Further, heat emitted from the IC drivers can be dissipated.

(Fifth Embodiment)

A driving method according to a fifth embodiment will now be described with reference to FIG. 16.

Figure 16:
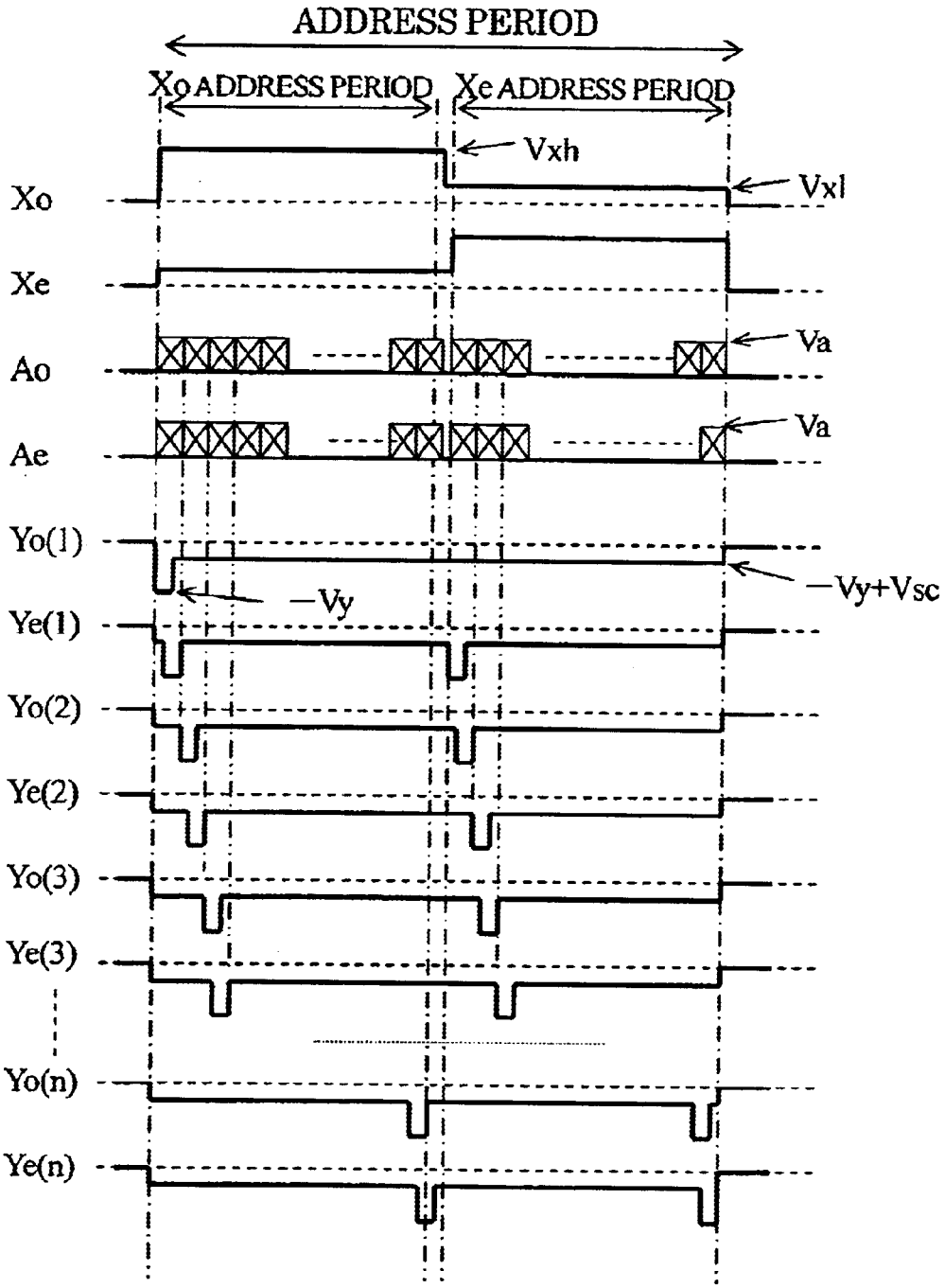
FIG. 16 shows driving waveforms according to a fifth embodiment.

In an "Xo address period" shown in FIG. 16, discharge cells that are scanned by the odd Y electrodes Yo are designated as odd cells. Further, discharge cells that are scanned by the even Y electrodes Ye are designated as even cells (Refer to FIG. 8 for the odd cells and even cells.). These cells are addressed by the odd A electrodes Ao and the even A electrodes Ae (Refer to FIG. 8.). That is to say, there is a group of cells that is scanned by the odd Y electrodes Yo and is addressed by the odd A electrodes Ao and there is another group of cells that is scanned by the even Y electrodes Ye and is addressed by the even A electrodes Ae.

According to this embodiment, as shown in FIG. 16, the PDP is driven so that the phases of scan pulses for the odd Y electrodes Yo and the even Y electrodes Ye are shifted.

Accordingly, in the case where the cells on and under single X electrode (an odd X electrode Xo or an even X electrode Xe) are addressed at the same time as in the first embodiment (FIG. 11), the peak value of an address discharge current that flows in the single X electrode (that is, current that flows into a driver that drives the electrode) is small. This feature is an advantage to the driving method.

Figure 17:
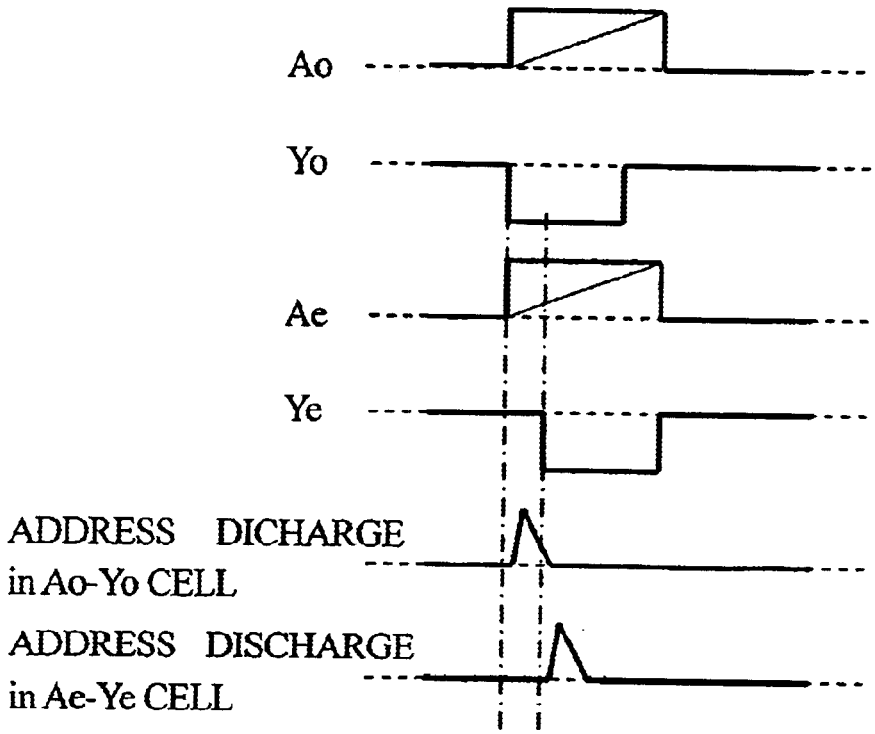
FIG. 17 is a partial enlarged view of the driving waveforms shown in FIG. 16.

As described above, the address discharge current is spread out by shifting the phases of the scan pulses as shown in a diagram of FIG. 17.

As shown in FIG. 17, the scan pulse for the even Y electrode Ye is applied a little later than the scan pulse for the odd Y electrode Yo. Subsequently, the phases of the scan pulses are shifted. In that case, an address discharge generated between the even Y electrode Ye and the odd A electrode Ae is generated a little later than an address discharge generated between the odd Y electrode Yo and the odd A electrode Ao, as shown in FIG. 17. Consequently, the timing of address discharge generation is distributed and the peak value of the address discharge current is reduced by half. Therefore, the instantaneous load on the driver is reduced by half, which is another advantage of the driving method.

It is preferable that the amount of a time for the above-described phase-shifting corresponds to that for the address discharging. In general, it is preferable that the time is from 200 to 500 ns or so.

(Sixth Embodiment)

In a sixth embodiment, a driving method for shifting the phases of driving pulses obtained by improving the driving method of the fifth embodiment is described with reference to FIG. 18.

According to the fifth embodiment, the widths of the two types of address pulses shown in FIG. 16 (the pulses for driving the two types of address electrodes Ao and Ae) are wide enough to cover the pair of scan pulses (the pulses for driving the two types of Y electrodes Yo and Ye), whose phases are shifted to one another. Therefore, the period of scanning becomes long, which is a disadvantage to the driving method.

Figure 18:
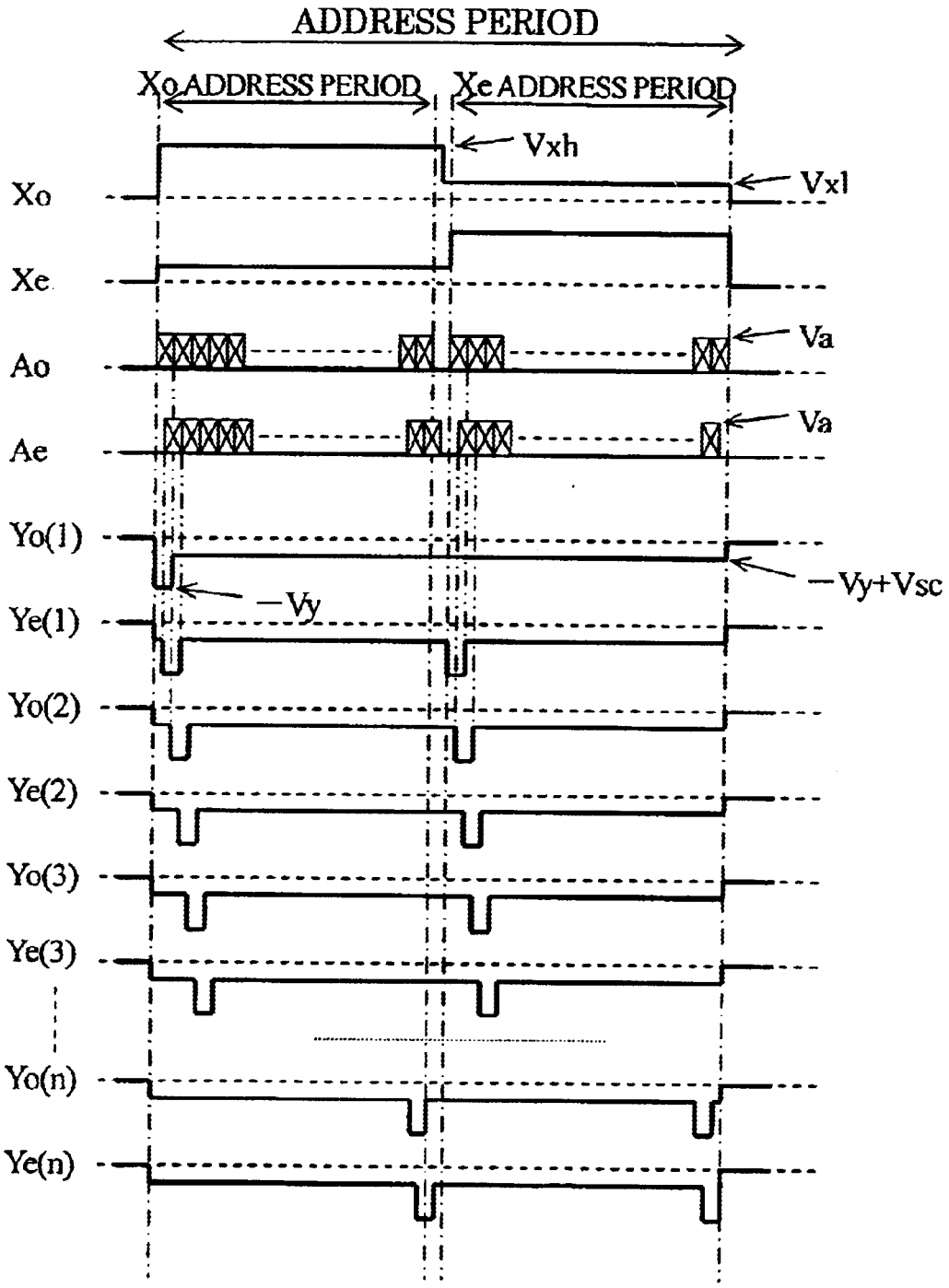
FIG. 18 shows driving waveforms according to a sixth embodiment.

Therefore, as shown in FIG. 18, the phases of the pulses for the two types of address electrodes Ao and Ae are shifted so as to correspond to the phases of the two types of scan pulses. Subsequently, the widths of pulses applied to the two types of address electrodes Ao and Ae are decreased. As a result, the addressing time can be decreased while maintaining the effects of the fifth embodiment.

(Seventh Embodiment)

The configuration and a method for driving a PDP according to a seventh embodiment will now be described with reference to FIGS. 19 and 20.

As has been described in the first and second embodiments, the adjacent Y electrodes Yo(n) and Ye(n) can be addressed by being addressed at the same time. Therefore, in the case of a PDP that handles the adjacent Y electrodes Yo(n) and Ye(n) as an identical electrode, addressing can be performed by driving the PDP by driving waveforms shown in FIG. 20.

Figure 19:
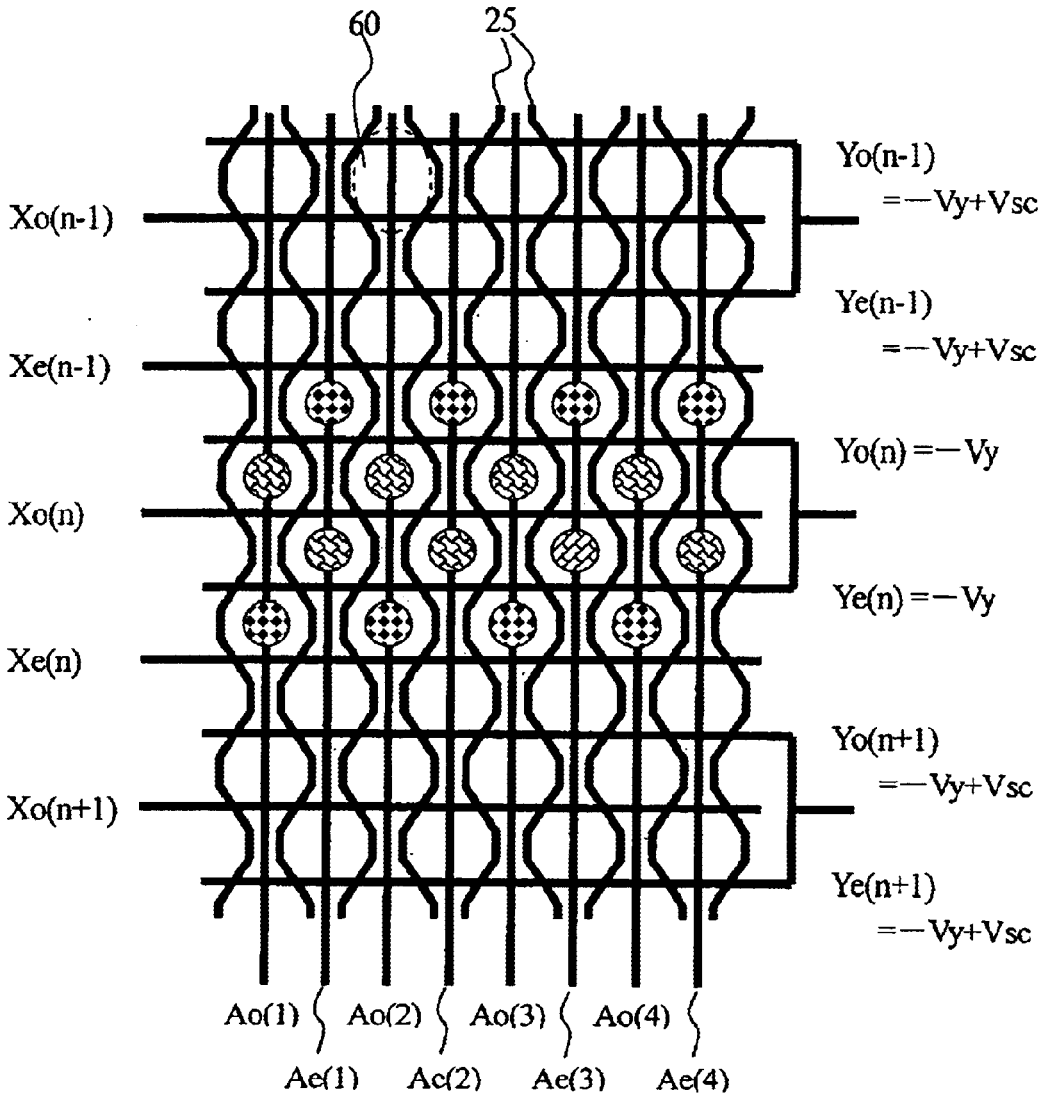
FIG. 19 shows the connection configuration of Y electrodes, scan cells and anti-scan cells in a PDP according to a seventh embodiment.

First, the configuration of the above-described PDP is shown in FIG. 19.

Figure 20:
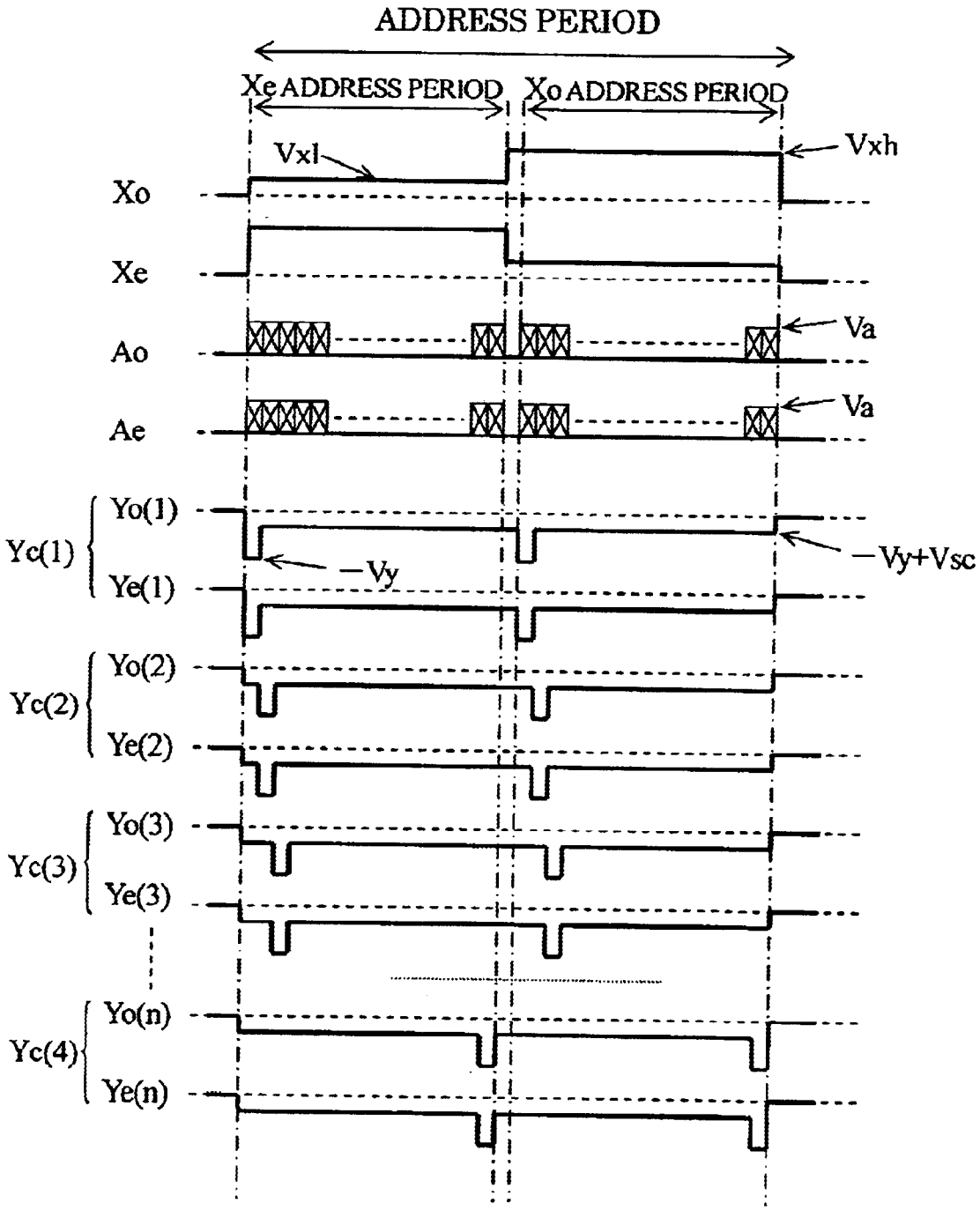
FIG. 20 shows driving waveforms according to the seventh embodiment.

Referring to the driving waveforms shown in FIG. 20, in the "Xo address period", discharge cells sandwiched between the adjacent Y electrodes Yo(n) and Ye(n) in the PDP shown in FIG. 19 are designated as scan cells. Further, in the "Xe address period", discharge cells that are provided outside, and adjacent to the Y electrodes Yo(n) and Ye(n) that are adjacent to each other in the PDP shown in FIG. 19 are designated as scan cells.

This embodiment is a combination of the first and second embodiments.

More specifically, in the "Xe address period", a group of cells (e.g., a group of cells between the electrodes Yo(n) and Xe(n−1) and another group of cells between the electrodes Ye(n) and Xe(n)) that are provided outside a pair of Y electrodes (e.g., the electrodes Yo(n) and Ye(n)) are scanned, as in the case of the second embodiment. Next, in the "Xo address period", a group of cells (a group of cells between the electrodes Yo(n) and Xo(n) and another group of cells between the electrodes Ye(n) and Xo(n)) that is provided between the pair of Y electrodes (the electrodes Yo(n) and Ye(n)) is scanned as in the case of the first embodiment.

According to the embodiment, the amount of address current flowing in the pair of Y electrodes Yo(n) and Ye(n) is reduced (by half) compared to the case where the known driving method is used, as in the cases of the first and second embodiments. Therefore, when these scan electrodes, that is, the Y electrodes are commonly connected and are driven by one driver, the amount of load on the driver becomes about the same as that in the known case. However, the number of drivers is reduced by half, which brings about another advantage to the PDP and the driving method therefor.

In the case of the above-described PDP, the number of output terminals of the Y electrodes is reduced by half. Subsequently, terminals of the PDP and those of the drivers can be easily connected, which brings about another advantage.

Figure 6:
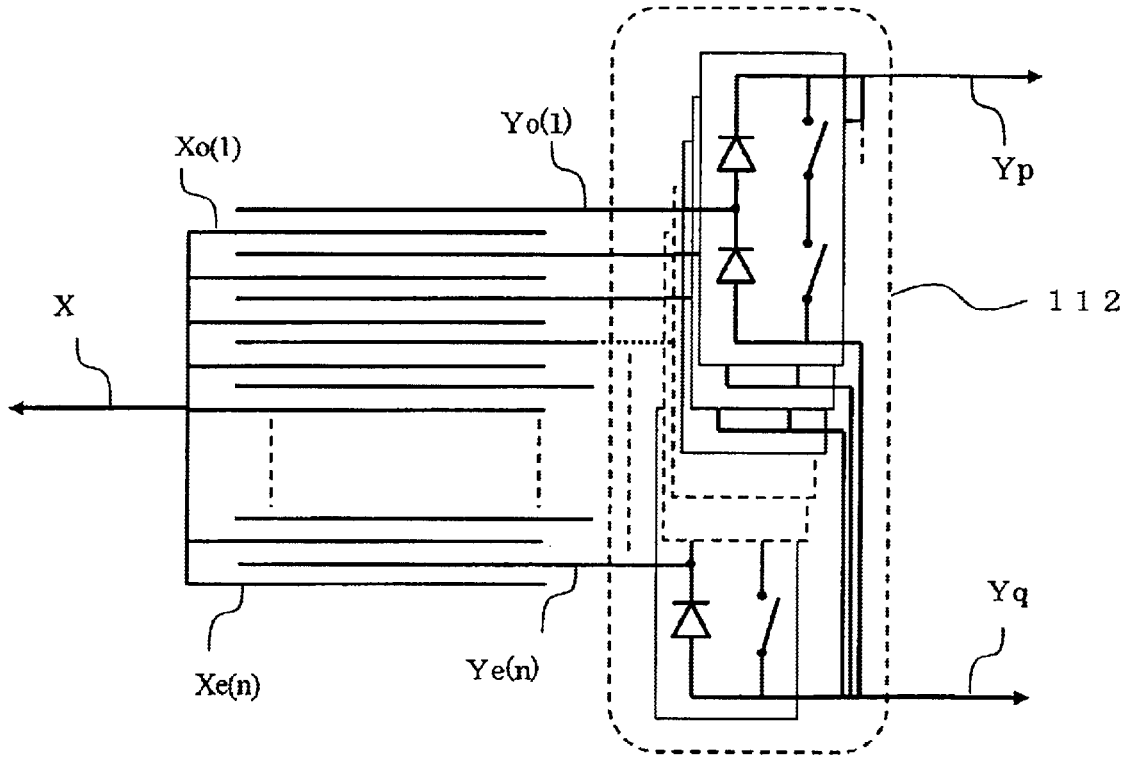
FIG. 6 schematically shows the connection between a Y scan driver and PDP electrodes.
Figure 21A:
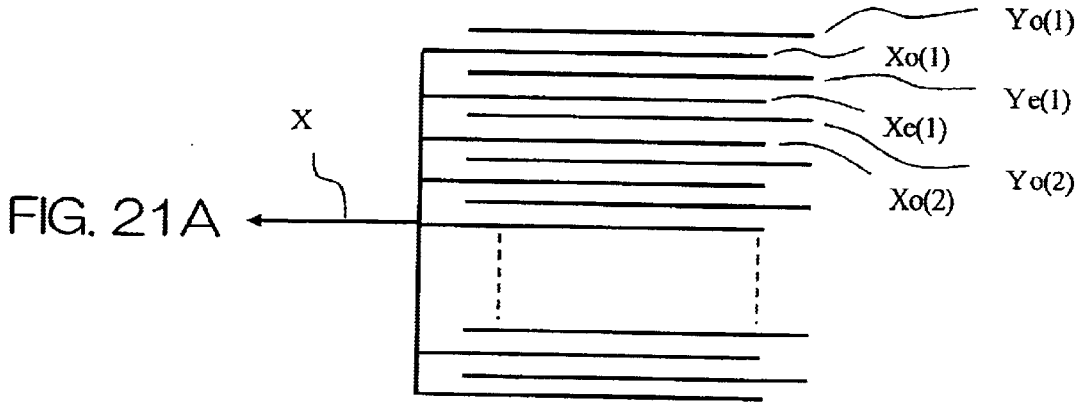
FIGS. 21A and 21B show the arrangement relationships between X electrodes and Y electrodes in PDPs.
Figure 21B:
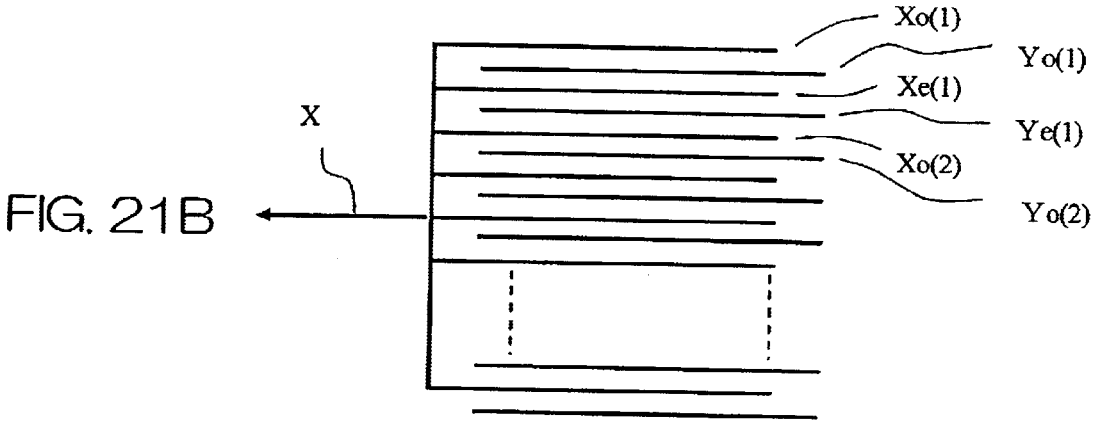

Further, in the above-described embodiments, as shown in FIGS. 6 and 8, for example, the electrodes of the PDP are arranged in the order Yo(1), Xo(1), Ye(1), Xe(1), and so forth from the upper end of the panel. (Hereinafter, this arrangement is referred to as "Y start".) However, the electrodes may be arranged in the order Xo(1), Yo(1), Xe(1), Ye(1), and so forth. (Hereinafter, this arrangement is referred to as "X start".) FIGS. 21A and 21B give a comparison of these types of arrangements. FIG. 21A shows the "Y start" and FIG. 21B shows the "X start".

The difference between the "Y start" and the "X start" changes (reverses) the relationship between the scan cells and the anti-scan cells or the like that has been described in the above-described embodiment.

For example, the driving waveforms shown in FIG. 10 for the PDP, whose terminals are arranged according to "Y start" of the first embodiment, are applied to a PDP whose terminals are arranged according to "X start", scan cells and anti-scan cells of the "X start" PDP do not correspond to those shown in FIG. 11, which was referred to in the first embodiment. The scan cells and anti-scan cells of the "X stat" PDP correspond to those shown in FIG. 13, which was referred to in the second embodiment. That is to say, the relationship between the scan cells and the anti-scan cells is reversed. Further, it becomes necessary to reverse the relationship between the "odd numbered" electrodes and the "even numbered" electrodes.

Figure 22:
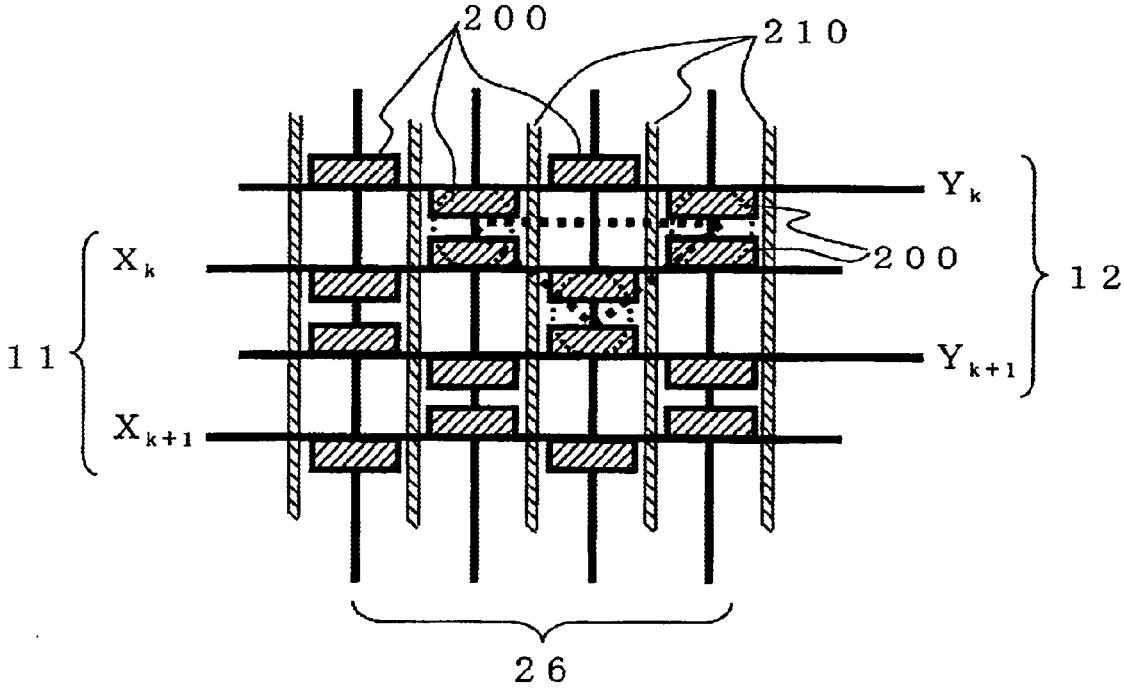
FIG. 22 schematically shows a plasma display panel having straight rids.

In the above each embodiment, the meandering rib PDP is used as PDP, however, the present invention can be used in a PDP having a straight rib shown in FIG. 1. FIG. 22 shows an embodiment in which the present invention is provided. In this embodiment, the ribs 210 are straight ribs as shown in FIG. 22. Each of Y- and X-electrodes 11 and 12 has the bus electrode and transparent electrodes 200 which are arranged periodically between adjacent ribs 210, and directions of the transparent electrodes 200 along address electrode 26 are alternatively and oppositely formed so that the pairs of transparent electrodes formed in Y- and X-electrodes Yk and Xk come close each other and can make a address discharge. Even in this embodiment, the fluorescent layers for emitting red, green, and blue lights are periodically provided each between a pair of ribs 210 in the same way as FIG. 1. Therefore, the cells for red, green, and blue can form the delta-shape as shown by dotted lines.

Further, in the above-described embodiments, the PDP having the delta-cell structure has been described. However, the present invention can be effective for a PDP having scan electrodes (Y electrodes) and common electrodes (X electrodes) that are arranged alternately, and discharge cells that are distributed so that the discharge cells are formed on and under the scan electrodes (that is to say, a PDP having discharge cells which are not all provided on or under the scan electrodes). The present invention can be more effective for a PDP having a group of discharge cells provided on the scan electrodes and another group of discharge cells, of about the same number as the former group, that are provided under the scan electrodes.

By using the methods of driving a PDP according to the above-described embodiments, the amount of current flowing in the scan electrodes (the Y electrodes) in the address period where the address discharging is performed can be spread out and reduced. Consequently, the load on the address driver can be reduced and address operations are stabilized.

Furthermore, by using the methods of driving a PDP according to the above-described embodiments, the amount of an address discharge current that flows in single scan electrode (a Y electrode) can be reduced. Further, the number of scan drivers and terminals of the Y electrode can be reduced by half.

Furthermore, by using a PDP device according to one aspect of the present invention, the heat emitted from the IC drivers, which drive the scan electrode (the Y electrode), can be dissipated. Consequently, the operations of the IC drivers can be stabilized.

What is claimed is:

1. A method of driving a plasma display panel comprising:

a plurality of first electrodes provided on a substrate;

a plurality of second electrodes, each of the plurality of second electrodes being provided between the plurality of first electrodes;

a plurality of third electrodes intersecting the first and second electrodes; and discharge cells that perform address discharging between the first electrodes and the third electrodes and sustaining discharging between the first electrodes and the second electrodes, and that can perform sustaining discharging between the first electrodes and the second electrodes that are adjacent to both sides of the first electrodes at the same time, wherein in an address period for performing the address discharging, two electrodes, one being an odd-numbered electrode and one being an even-numbered electrode, of the first electrodes are paired with each other and are scanned in a predetermined order, and the address period is divided into a first period and a second period, wherein, in the first period one of one group of odd-numbered electrodes and another group of even-numbered electrodes of the second electrodes is put in a selected state and the other group is put in an anti-selected state, and in the second period the other group of electrodes is put in the selected state and the one group of electrodes is put in the anti-selected state for scanning the pair of first electrodes.

2. A method of driving a plasma display panel according to claim 1, wherein two adjacent electrodes of the first electrodes are used as the pair of electrodes, one being the odd numbered electrode and one being the even numbered electrode.

3. A method of driving a plasma display panel according to claim 2, wherein one of one group of odd-numbered electrodes and another group of even-numbered electrodes of the second electrodes corresponding to a second electrode between the two adjacent first electrodes is put in a selected state and the other group of second electrodes is put in an anti-selected state.

4. A method of driving a plasma display panel according to claim 2, wherein one of one group of odd-numbered electrodes and another group of even-numbered electrodes of the second electrodes corresponding to second electrodes that are outside and adjacent to the pair of first electrodes, which are adjacent to each other, is put in a selected state and the other group of second electrodes is put in an anti-selected state.

5. A method of driving a plasma display panel according to claim 1, wherein when the two electrodes, one being an odd-numbered electrode and one being an even-numbered electrode, of the first electrodes are paired with each other and are scanned in a predetermined order, the phase of a scan pulse applied to one of the pair of first electrodes and the phase of another scan pulse applied to the other of the pair of first electrodes are shifted.

6. A method of driving a plasma display panel according to claim 5, wherein two types of address pulses are applied to the third electrodes corresponding to the scan pulses, which are applied to the first electrodes, for choosing between an on state and an off state of the discharge cells, and wherein the phases of the two types of address pulses, which are applied corresponding to the pair of first electrodes, are shifted so that the phases of the two types of address pulses correspond to the phases of the scan pulses, which are applied to the pair of first electrodes.

7. A method of driving a plasma display panel according to claim 1, wherein a pair of adjacent electrodes of the first electrodes are commonly connected at all times, in one of the first period and the second period, one of one group of odd-numbered electrodes and another group of even-numbered electrodes of the second electrodes corresponding to a second electrode between the pair of first electrodes is put in a selected state and the other group of second electrodes is put in an anti-selected state, and in the other period, one of one group of odd-numbered electrodes and another group of even-numbered electrodes of the second electrodes corresponding to second electrodes that are outside, and adjacent to the pair of first electrodes is put in a selected state and the other group of second electrodes is put in an anti-selected state.

8. A plasma display panel used for a driving method according to claim 7, comprising:

a plurality of first electrodes provided on a substrate;

a plurality of second electrodes, each of the plurality of second electrodes being provided between the plurality of first electrodes;

a plurality of third electrodes intersecting the first and second electrodes; and discharge cells that perform address discharging between the first electrodes and the third electrodes and sustaining discharging between the first electrodes and the second electrodes, and that can perform sustaining discharging-between the first electrodes and the second electrodes that are adjacent to both sides of the first electrodes at the same time, wherein adjacent electrodes of the first electrodes are paired with each other and are commonly connected.

9. A plasma display panel according to claim 8, further comprising at least one meandering barrier for separating discharges.

10. A plasma display device comprising:

a plasma display panel having a plurality of first electrodes provided on a substrate, a plurality of second electrodes, each of the plurality of second electrodes being provided between the plurality of first electrodes, a plurality of third electrodes intersecting the first and second electrodes, and discharge cells that perform address discharging between the first electrodes and the third electrodes and sustaining discharging between the first electrodes and the second electrodes, and that can perform sustaining discharging between the first electrodes and the second electrodes that are adjacent to both sides of the first electrodes at the same time; and at least one driving circuit for driving the first electrodes, the second electrodes, and the third electrodes, wherein the driving circuit includes a plurality of IC drivers having a plurality of drivers for addressing the plurality of first electrodes, and odd numbered electrodes of the first electrodes and even numbered electrodes of the first electrodes are connected to different IC drivers.

* * * * *

UNITED STATES PATENT AND TRADEMARK OFFICE

CERTIFICATE OF CORRECTION

PATENT NO. : 6,909,241 B2
DATED : June 21, 2005
INVENTOR(S) : Yoshiho Seo et al.

It is certified that error appears in the above-identified patent and that said Letters Patent is hereby corrected as shown below:

Title page,
Item [57], ABSTRACT,
Line 8, replace "electroded" with -- electrodes --.
Line 13, replace "stae" with -- state --.
Line 13, replace "scnning" with -- scanning --.
Line 13, after "pair" insert -- of --.
Lines 13-14, replace "ellectrodes" with -- electrodes --.

Column 12,
Line 37, replace "odd numbered" with -- odd-numbered --.
Line 37, replace "even numbered" with -- even-numbered --.

Column 14,
Line 2, after "discharging" delete "-".
Line 28, replace "odd numbered" with -- odd-numbered --.
Line 29, replace "even numbered" with -- even-numbered --.

Signed and Sealed this

Twenty-eighth Day of March, 2006

JON W. DUDAS
*Director of the United States Patent and Trademark Office*